US006172662B1

(12) United States Patent
Ito et al.

(10) Patent No.: US 6,172,662 B1
(45) **Date of Patent: *Jan. 9, 2001**

(54) METHOD OF DRIVING LIQUID CRYSTAL DISPLAY DEVICE, A LIQUID CRYSTAL DISPLAY, ELECTRONIC EQUIPMENT AND A DRIVING CIRCUIT

(75) Inventors: Akihiko Ito; Takashi Kurumisawa, both of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/592,396

(22) PCT Filed: Jun. 5, 1995

(86) PCT No.: PCT/JP95/01098

§ 371 Date: Apr. 18, 1996

§ 102(e) Date: Apr. 18, 1996

(87) PCT Pub. No.: WO95/34020

PCT Pub. Date: Dec. 14, 1995

(30) Foreign Application Priority Data

Jun. 3, 1994 (JP) ..... 6-122832
Mar. 7, 1995 (JP) ..... 7-046940

(51) Int. Cl.[7] ..... G09G 3/36
(52) U.S. Cl. ..... 345/94; 345/96
(58) Field of Search ..... 345/58, 68, 87, 345/94–100

(56) References Cited

U.S. PATENT DOCUMENTS 4,915,477 * 4/1990 Ohta et al. ..... 345/94
5,010,326 4/1991 Yamazaki et al. .
5,119,085 6/1992 Yamazaki .
5,151,690 9/1992 Yamazaki .
5,175,535 12/1992 Yamazaki et al. .
5,179,371 1/1993 Yamazaki .
5,184,118 2/1993 Yamazaki .
5,202,676 4/1993 Yamazaki .
5,214,417 5/1993 Yamazaki .
5,233,447 * 8/1993 Kuribayashi et al. ..... 345/97
5,262,881 11/1993 Kuwata et al. .
5,298,914 3/1994 Yamazaki .
5,442,370 8/1995 Yamazaki et al. .
5,777,592 * 7/1998 Mihara et al. ..... 345/94

FOREIGN PATENT DOCUMENTS

WO 93/18501 9/1993 (WO) .

OTHER PUBLICATIONS

Ruckmongathan, T.N. "A Generalized Addressing Technique for RMS Responding Matrix LCDs." *1988 International Display Research Conference*, pp. 80–85, 1988.

* cited by examiner

*Primary Examiner*—Bipin H. Shalwala
*Assistant Examiner*—David L Lewis
(74) *Attorney, Agent, or Firm*—Oliff & Berridge, PLC

(57) ABSTRACT

The present invention: (1) divides a selection period into a plurality of sub-selection periods (t11, t21, t31, t41), and distributes these sub-selection periods throughout the period in one frame; (2) further divides a sub-selection period into a plurality of divided sub-selection periods ((s1, s2), (s3, s4), (s5, s6), (s7, s8)), and switches electric potentials of the selection signals between divided sub-selection period in order to eliminate the effects of spikes in voltage from the scanning signals to be applied to adjacent scanning electrodes, and applies these features to commonly known multi-line driving method. The present invention is capable of: (1) controlling unevenness of display in the direction of signal electrodes (normally vertical direction), (2) not causing especially severe uneven display in the direction of signal electrodes and flickering even when the display contents change one after another, and (3) preventing the occurrence of an uneven display in the direction of scanning electrodes (normally horizontal direction).

41 Claims, 23 Drawing Sheets

| | | 1f | | 2f | | 3f | | 4f | |
|---|---|---|---|---|---|---|---|---|---|
| G1 | X1 | + | + | + | + | + | — | — | + |
| | X2 | + | + | — | — | + | — | + | — |
| | X3 | + | — | + | — | + | + | — | — |
| | X4 | + | — | — | + | + | + | + | + |
| G2 | X5 | + | + | + | + | — | + | + | — |
| | X6 | + | + | — | — | — | + | — | + |
| | X7 | — | + | — | + | + | + | — | — |
| | X8 | — | + | + | — | + | + | + | + |
| G3 | X9 | + | + | + | + | + | — | — | + |
| | X10 | + | + | — | — | + | — | + | — |
| | X11 | + | — | + | — | + | + | — | — |
| | X12 | + | — | — | + | + | + | + | + |
| G4 | X13 | + | + | + | + | — | + | + | — |
| | X14 | + | + | — | — | — | + | — | + |
| | X15 | — | + | — | + | + | + | — | — |
| | X16 | — | + | + | — | + | + | + | + |

FIG.5

| | | 1f | | 2f | | 3f | | 4f | | 5f | | 6f | | 7f | | 8f | |
|---|---|---|---|---|---|---|---|---|---|---|---|---|---|---|---|---|---|
| G1 | X1 | + | + | + | − | − | − | + | − | + | + | − | + | − | − | − | + |
| | X2 | + | − | + | + | − | − | − | + | − | + | + | + | − | − | + | − |
| | X3 | − | + | − | + | − | − | + | + | + | − | + | − | − | − | + | + |
| | X4 | + | + | − | − | + | − | − | + | + | + | − | − | − | + | + | − |
| | X5 | + | + | − | + | − | + | − | − | + | + | + | − | + | − | − | − |
| | X6 | + | − | − | − | − | + | + | + | − | + | − | − | + | − | + | + |
| G2 | X7 | + | + | − | + | − | − | − | + | + | + | + | − | − | − | + | − |
| | X8 | − | + | + | + | − | − | + | − | + | − | + | + | − | − | − | + |
| | X9 | + | − | + | − | − | − | + | + | − | + | − | + | − | − | + | + |
| | X10 | + | + | − | − | − | + | + | − | + | + | − | − | + | − | − | + |
| | X11 | + | + | + | − | + | − | − | − | + | + | − | + | − | + | − | − |
| | X12 | − | + | − | − | + | − | + | + | + | − | − | − | − | + | + | + |
| G3 | X13 | + | + | + | − | − | − | + | − | + | + | − | + | − | − | − | + |
| | X14 | + | − | + | + | − | − | − | + | − | + | + | + | − | − | + | − |
| | X15 | − | + | − | + | − | − | + | + | + | − | + | − | − | − | + | + |
| | X16 | + | + | − | − | + | − | − | + | + | + | − | − | − | + | + | − |
| | X17 | + | + | − | + | − | + | − | − | + | + | + | − | + | − | − | − |
| | X18 | + | − | − | − | − | + | + | + | − | + | − | − | + | − | + | + |
| G4 | X19 | + | + | − | + | − | − | − | + | + | + | + | − | − | − | + | − |
| | X20 | − | + | + | + | − | − | + | − | + | − | + | + | − | − | − | + |
| | X21 | + | − | + | − | − | − | + | + | − | + | − | + | − | − | + | + |
| | X22 | + | + | − | − | − | + | + | − | + | + | − | − | + | − | − | + |
| | X23 | + | + | + | − | + | − | − | − | + | + | − | + | − | + | − | − |
| | X24 | − | + | − | − | + | − | + | + | + | − | − | − | − | + | + | + |

FIG.6

| | | 1f | | 2f | | 3f | | 4f | |
|---|---|---|---|---|---|---|---|---|---|
| G1 | X1 | + | − | + | + | + | − | − | − |
| | X2 | − | + | + | + | − | + | − | − |
| | X3 | + | + | − | + | − | − | − | + |
| | X4 | + | + | + | − | − | − | + | − |
| G2 | X5 | − | + | + | + | − | + | − | − |
| | X6 | + | − | + | + | + | − | − | − |
| | X7 | + | + | + | − | − | − | + | − |
| | X8 | + | + | − | + | − | − | − | + |
| G3 | X9 | + | − | + | + | + | − | − | − |
| | X10 | − | + | + | + | − | + | − | − |
| | X11 | + | + | − | + | − | − | − | + |
| | X12 | + | + | + | − | − | − | + | − |
| G4 | X13 | − | + | + | + | − | + | − | − |
| | X14 | + | − | + | + | + | − | − | − |
| | X15 | + | + | + | − | − | − | + | − |
| | X16 | + | + | − | + | − | − | − | + |

FIG.7

| | | 1f | | 2f | | 3f | | 4f | |
|---|---|---|---|---|---|---|---|---|---|
| G1 | X1 | + | − | + | + | − | + | + | + |
| | X2 | − | + | + | + | + | − | + | + |
| | X3 | + | + | − | + | + | + | + | − |
| | X4 | + | + | + | − | + | + | − | + |
| G2 | X5 | − | + | + | + | + | − | + | + |
| | X6 | + | − | + | + | − | + | + | + |
| | X7 | + | + | + | − | + | + | − | + |
| | X8 | + | + | − | + | + | + | + | − |
| G3 | X9 | + | − | − | − | − | + | − | − |
| | X10 | − | + | − | − | + | − | − | − |
| | X11 | − | − | − | + | − | − | + | − |
| | X12 | − | − | + | − | − | − | − | + |
| G4 | X13 | − | + | − | − | + | − | − | − |
| | X14 | + | − | − | − | − | + | − | − |
| | X15 | − | − | + | − | − | − | − | + |
| | X16 | − | − | − | + | − | − | + | − |

FIG.8

| | $t_1$ | $t_2$ | $t_3$ | $t_4$ | $t_5$ | $t_6$ | $t_7$ | $t_8$ | $t_9$ | $t_{10}$ | $t_{11}$ | $t_{12}$ | $t_{13}$ | $t_{14}$ | $t_{15}$ | $t_{16}$ |
|---|---|---|---|---|---|---|---|---|---|---|---|---|---|---|---|---|
| $X_1$ | + | + | + | − | − | − | + | − | − | + | − | − | − | + | + | + |
| $X_2$ | + | − | + | + | − | − | − | + | + | − | − | − | + | + | − | + |
| $X_3$ | − | + | − | + | − | − | + | + | + | + | − | − | + | − | + | − |
| $X_4$ | + | + | − | − | + | − | − | + | + | − | − | + | − | − | + | + |
| $X_5$ | + | + | − | + | − | + | − | − | − | − | + | − | + | − | + | + |
| $X_6$ | + | − | − | − | − | + | + | + | + | + | + | − | − | − | − | + |

FIG. 11

| | t1 | t2 | t3 | t4 | t5 | t6 | t7 | t8 | t9 | t10 | t11 | t12 | t13 | t14 | t15 | t16 |
|---|---|---|---|---|---|---|---|---|---|---|---|---|---|---|---|---|
| $X_1$ | + | + | + | − | − | − | + | − | − | + | − | − | − | + | + | + |
| $X_2$ | + | − | + | + | − | − | − | + | + | − | − | − | + | + | − | + |
| $X_3$ | − | + | − | + | − | − | + | + | + | + | − | − | + | − | + | − |
| $X_4$ | + | + | − | − | + | − | − | + | + | − | − | + | − | − | + | + |
| $X_5$ | + | + | − | + | − | + | − | − | − | − | + | − | + | − | + | + |
| $X_6$ | + | − | − | − | − | + | + | + | + | + | + | − | − | − | − | + |

FIG.14

METHOD OF DRIVING LIQUID CRYSTAL DISPLAY DEVICE, A LIQUID CRYSTAL DISPLAY, ELECTRONIC EQUIPMENT AND A DRIVING CIRCUIT

BACKGROUND OF THE INVENTION

1. Field of the Invention

The present invention relates to a driving method of a liquid crystal display device, more specifically, an improved driving method for a simple matrix type liquid crystal display device. Moreover, the present invention relates to a liquid crystal display device which uses the above driving method for a liquid crystal display device. Furthermore, the present invention relates to electronic equipment comprising such a liquid crystal display device. In addition, the present invention relates to a driving circuit which drives such a liquid crystal display device.

2. Description of Related Art

A driving method for a conventional simple matrix type liquid crystal display device method selects the scanning electrode(s) in order, one by one.

Another driving method for a conventional simple matrix type liquid crystal display device is a driving method commonly known as the IHAT driving method, wherein a plurality of scanning electrodes are simultaneously selected using an orthogonal matrix while maintaining their orthogonality. This driving method is disclosed in a Generalized Addressing Technique for RMS Responding Matrix LCDS, 1988 International Display Research Conference P80–P85, in which the article states that the lowering of voltage for a liquid crystal display device is feasible.

However, although conventional simple matrix type liquid crystal display devices are advantageous in the sense that manufacturing costs are less expensive than for an active matrix type liquid crystal display, they are disadvantageous in another sense that both high speed response characteristics and excellent contrast characteristics are not satisfied.

A technology commonly known as the multi-line driving method is disclosed in U.S. Pat. No. 5,262,881, and in the international patent application WO93/18501 wherein such problems of conventional simple matrix type liquid crystal display device are resolved and both high speed response characteristics and excellent contrast characteristics are satisfied by dividing the selection period into a plurality of sub-selection periods, the sub-selection periods being scattered within one frame period.

The multi-line driving methods disclosed in the above public notices are described hereafter with reference to FIGS. 20 through 23.

To begin with, the liquid crystal display device for which the multi-line driving methods are applied is a simple matrix type liquid crystal display device (200) and comprises a plurality of scanning electrodes (203), a plurality of signal electrodes (204), and display elements (Eij). Moreover, scanning signals (X1–Xn) are applied to the scanning electrodes to provide selection signals (V1 or –V1) for selection periods and non-selection signal (0V) for non-selection periods while data signals (Y1–Ym) are applied to the signal electrodes based on the display data. The display element is driven by the scanning signals and data signals.

The scanning electrodes are divided into a plurality of groups, and selection signals (X1–X4) which are mutually orthogonal in one frame are given in bulk for each of the scanning electrodes belonging to the same group.

The selection period is divided into four mutually exclusive sub-selection periods (t11–t41) with the selection signal electric potential being established for each of four sub-selection periods.

The data signals (Y1, Y2, . . . ) are determined by comparing the polarity (+/–) of the electric potential of the selection signals based on the electric potential of the non-selection signals and the display data of the display elements.

However, with such a driving method, there has been a problem of uneven display in the direction of signal electrodes (normally the vertical direction). In explaining the reason for the problem with reference to FIG. 21, the cause of the problem is that when the data signal with the pattern described by Y1, (for example, the data signal to which voltage V3 is applied only for the period described by 2*f* in one frame and no voltage is applied for other periods), is applied to the signal electrodes, a shift based on time occurs in the distribution of the voltage applied to the display elements (Eij) compared to other patterns displaying the same luminance signals, causing an uneven display. This uneven display is especially noticeable when the response is fast.

Moreover, such a driving method presents another problem in which the unevenness of the display becomes severe and flickering occurs when the display contents are changed one after another. This problem is explained with reference to FIG. 22. The driving method of FIG. 22 is similar to the driving method used in FIG. 21. In the first selection period t11, selection signals comprising scanning signals X1–X4 are simultaneously applied to the first four scanning electrodes and in the next selection period t12 (not shown), selection signals comprising scanning signals X5–X8 (not shown) are applied simultaneously to the next four scanning electrodes. This voltage application is repeated for all of the scanning electrodes (X1–Xn) and for all of the field (1*f*–4*f*). Luminance (transmittance rate or reflection rate) (T1, T2) changes one after another based on the voltage applied to the display elements.

If the display screen does not change between the first frame and the second frame, then the change in luminance is periodic (see T1) and the unevenness of the display does not become especially severe. On the other hand, if the display screen changes between the first frame and the second frame, then the change in the luminance is not periodic (see T2) and the unevenness of the display becomes especially severe and flickering occurs.

As explained above, the driving method disclosed in the U.S. Pat. No. 5,262,881 and the driving method disclosed in international application WO93/18501 have the merit of improving the problems of poor response characteristics and extremely low contrast characteristics in a conventional simple matrix type liquid crystal display device. However, these driving methods have their own problems such as (1) an uneven display occurs in the direction of the signal electrode (normally the vertical direction) and (2) the uneven display becomes especially severe and flickering occurs when the display contents change one after another.

The present invention aims to resolve the problems of the above-stated conventional driving methods by providing a driving method of the liquid crystal display device capable of (1) controlling the unevenness of display in the direction of signal electrode(s) (normally the vertical direction) and (2) not causing an especially severe uneven display in the direction of the signal electrode(s) nor flickering even when the display contents change one after another.

SUMMARY OF THE INVENTION

The purpose of the present invention is to accomplish the above.

To begin with, the liquid crystal display device for which the present invention and commonly known multi-line driving method are applied is a simple matrix type liquid crystal display device (200) described in FIG. 20 comprising a plurality of scanning electrodes (203), a plurality of signal electrodes (204) and display elements (Eij). Moreover, as described in FIG. 1, scanning signals (X1–Xn) are applied to the scanning electrodes to provide selection signals (V1 or –V1) for the selection period and non-selection signal (0V) for the non-selection period while data signals (Y1–Ym) are applied to the signal electrodes based on the display data. The display element is driven by the scanning signals and the data signals.

The scanning electrodes are divided into a plurality of groups, and selection signals (X1–X4) which are mutually orthogonal in a certain period are provided for the scanning electrodes belonging to the same group.

The selection period is divided into p mutually separated sub-selection periods (t11–t41) with a selection signal electric potential being established for each of the p sub-selection periods.

The data signals (Y1, Y2, . . . ) are determined according to a comparison made between the polarity (+/–) of the electric potential of selection signals based on the electric potential of the non-selection signals and the display data of the display elements.

The present invention will be explained hereafter in more detail based on the statements and the Scope of claims.

In the invention according to claim 1, each of the sub-selection periods (t11, t21, t31, t41) is divided into q (q is an integer greater than 1) periods (hereafter "divided sub-selection period) ((s1, s2), (s3, s4), (s5, s6), (s7, s8)) and the electric potential of the selection signals are switched in the p×q divided sub-selection periods within one frame so that the effect of spikes in voltage from the scanning signals applied to the adjacent scanning voltage is eliminated within a certain period (one frame in FIG. 1).

In other words, by dividing each of the sub-selection periods into a plurality of periods and by providing a structure wherein the electric potential of the selection signals in the plurality of periods is to be switched appropriately, a shift in the voltage applied to the display elements based on time can be scattered and made uniform, resulting in (1) controlling of the unevenness of the display in the direction of the signal electrode (normally the vertical direction) and (2) not causing an especially severe uneven display in the direction of the signal electrode nor flickering even when the display contents change one after another.

In addition, by providing a structure wherein the electric potential of the selection signals in the plurality of periods is to be switched appropriately, so that the effect of a spike in voltage from the scanning signals applied to the adjacent scanning voltage is eliminated within a certain period, (3) the occurrence of an uneven display in the direction of the scanning electrode (normally the horizontal direction) is prevented.

In the invention according to claim 2, the shift of the voltage applied to the display elements and based on time is further both scattered and made uniform by providing a structure wherein the selection signals to be applied on the scanning electrodes belonging to the same group become mutually orthogonal in each of the periods ((s1+s2+s3+s4) and (s5+s6+s7+s8) in FIG. 1). In each of the periods, the former p divided sub-selection periods in one frame or the latter p divided sub-selection periods in one frame are all contained, resulting in a further strengthening of (1) the control of the unevenness of the display in the direction of the signal electrode (normally the vertical direction) and (2) not causing an especially severe uneven display in the direction of the signal electrode nor flickering even when the display contents change one after another.

In the invention according to claim 3, by making q an even number, the effect of spikes in voltage from the scanning signals applied to the adjacent scanning voltage is eliminated within one frame, resulting in a further strengthening of (3) the prevention of the occurrence of an uneven display in the direction of the scanning electrode (normally horizontal direction).

In the invention according to claim 4, by making q to be 2, the effects (1), (2) and (3) mentioned above are achieved through a relatively simple and low drive frequency drive wave pattern, enabling a reduction in the electric current consumption of the liquid crystal display device.

In the invention according to claim 5, a structure is provided wherein the polarity of voltage to be applied to the display elements reverses with certain periodicity, hence an uneven display caused by unevenness between the liquid crystal cell boards is controlled, and at the same time, the life time of the liquid crystal panel is extended.

With the invention according to claim 6, the polarity of the voltage to be applied to the display elements is not reversed within the same field but, by providing a structure wherein:

the polarity based on the electric potential of the non-selection signal of the electric potential of selection signals to be applied to the last divided sub-selection period (s2) out of the q divided sub-selection periods (s1, s2) in a sub-selection period (t11, for example) out of selection signals to be applied to certain scanning electrode(s) belonging to certain group (G1, for example), and the polarity based on the electric potential of the non-selection signal of the electric potential of selection signals to be applied to the first divided sub-selection period (s1) out of the q divided sub-selection periods (s1, s2) in the sub-selection period (t12) out of selection signals to be applied to the scanning electrode corresponding to the certain scanning electrode out of scanning electrodes belonging to a group (G2, for example) to be selected as the next group are made to have the same sign, the number of off/on switching of data signals (Y1, Y2, . . . ) can be reduced, resulting in a lowering of electric current consumption by the liquid crystal display device.

In the invention according to claim 7, there are instances in which:

the polarity of the electric potential to be applied to the display elements selected by the selection signals (X1, for example) to be applied to certain scanning electrode belonging to a certain group (G1, for example), and the polarity of the electric potential to be applied to display elements selected by the selection signals (X5) to be applied to the scanning electrode belonging to a group (G2) to be selected as the next group and corresponding to the certain scanning electrode may or may not be reversed in the same field, and a structure is provided wherein in the case in which two polarities are not reversed:

the polarity based on the electric potential of the non-selection signal of the electric potential of selection signals to be applied to the last divided sub-selection period (s2) out of the q divided sub-selection periods (s1, s2) in the sub-selection period (t11, for example) out of selection signals to be applied to certain scanning electrode belonging to certain group (G1, for example), and the polarity based on the electric potential of the non-selection signal of the electric potential of selection signals to be applied to the first divided sub-selection period (s1) out of the q divided sub-selection periods (s1, s2) in the sub-selection period (t12) out of selection signals to be applied to the scanning electrode corresponding to the certain scanning electrode out of scanning electrodes belonging to a group (G2, for example) to be selected as the next group, are made to have the same sign, hence, the number of off/on switching of data signals (Y1, Y2, . . . ) can be reduced even when commonly known polarity reversal is executed for plurality of scanning lines as a unit, resulting in lowering of electric current consumption by the liquid crystal display device.

In the invention according to claim 8, a structure is provided wherein the place is changed for each field or each frame wherein:

the polarity of the electric potential to be applied to display elements selected by the selection signals (X1, for example) to be applied to the certain scanning electrode belonging to certain group (G1, for example), and the polarity of the electric potential to be applied to display elements selected by the selection signals (X5) to be applied to the scanning electrode belonging to a group (G2) to be selected as the next group and corresponding to the certain scanning electrode, are reversed in the same field, hence uneven display in the horizontal direction which sometimes occurs due to polarity reversal is eliminated.

In the invention according to claim 9, a structure is provided wherein q is made even and the order of the pattern of the appearance of the electric potential is reversed between the selection signals given during the first (p×q/2) divided sub-selection periods and the selection signals given during the last (p×q/2) divided sub-selection periods out of p×q divided sub-selection periods of one frame, hence, the shift of the voltage based on time to be applied to display elements is further scattered and made uniform, resulting in the further strengthening of:

(1) the controlling of unevenness of display in the direction of signal electrode (normally the vertical direction) and (2) not causing of an especially severe uneven display in the direction of signal electrode nor flickering even when the display contents change one after another.

In the invention according to claim 10, a structure is provided wherein the electric potential of the selection signals are switched during p×q divided sub-selection periods in one frame to prevent elimination of the effect of spikes in the voltage from the scanning signals to be applied to adjacent scanning electrode, hence the effects of:

(1) controlling of unevenness of display in the direction of signal electrode (normally vertical direction) and (2) not causing of especially severe uneven display in the direction of signal electrode nor flickering even when the display contents change one after another is achieved, through the effect of the (3) controlling of uneven display in the direction of the scanning electrode (normally horizontal direction) is not achieved, contributing to an increased degree of freedom in determining selection signals and to an enriching of the technological capabilities.

In the invention according to claim 11, a structure is provided wherein q is made to be 2 and in addition to the order of the pattern of the appearance of the electric potential being reversed between the selection signals given during the first p divided sub-selection periods and the selection signals given during the last p divided sub-selection periods out of p×q divided sub-selection periods of one frame, the order of the pattern of the appearance of the electric potential of the selection signals is reversed within the same sub-selection period during the last p divided sub-selection periods.

In the invention according to claim 12, a structure is provided wherein p is made to be 4, q is made to be 2, and in addition to the order of the pattern of the appearance of the electric potential being reversed between the selection signals given during the first 4 divided sub-selection periods and the selection signals given during the last 4 divided sub-selection periods of one frame:

the electric potential of the selection signals of the second divided sub-selection period and the electric potential of the selection signals of the third divided sub-selection period out of the last four divided sub-selection periods are mutually switched.

Similar to the invention according to claim 10, the invention of both claim 11 and claim 12 contribute to the enrichment of technological capabilities, and at the same time displaying the above-stated effects using a relatively simple and low driving frequency driving wave pattern, enabling reduction of the electric current consumption of the liquid crystal display device.

In the invention according to claim 13, a structure is provided in a commonly known multi-line driving method wherein each of the sub-selection periods (t11, t21, t31, t41) is divided into q (q is an integer greater than 1) periods (hereafter "divided sub-selection period) ((s1, s2), (s3, s4), (s5, s6), (s7, s8)); these p×q divided sub-selection periods are mutually separated, and the electric potential of the selection signals are switched in the divided sub-selection periods, hence:

(1) controlling the unevenness of the display in the direction of signal electrode (normally vertical direction) and (2) not causing especially severe uneven display in the direction of signal electrode nor flickering even when the display contents change one after another are achieved, at the same time effects such as (3) prevention of occurrence of uneven display in the direction of scanning electrode (normally horizontal direction) is obtained because the electric potentials of selection signals do not change within the same sub-selection periods.

In the invention according to claim 14, a structure is provided wherein the patterns of switching the electric potential of selection signals are made different between p×q divided sub-selection periods in one frame for each block in the display screen having different timing for switching display data. Hence, even in the liquid crystal display device with reduced memories for computation to determine data signals, effects such as:

(1) controlling of the unevenness of display in the direction of signal electrode (normally vertical direction) and (2) not causing of especially severe uneven display in the direction of signal electrode nor flickering even when the display contents change one after another, and (3) prevention of the occurrence of uneven display in the direction of the scanning electrode (normally horizontal direction) are achieved.

The liquid crystal display device based on the invention according to claim 15 is a liquid crystal display device using a driving method of the liquid crystal display device described above. Hence it is a relatively inexpensive simple matrix type liquid crystal display device, yet it has both high speed response characteristics and excellent contrast characteristics as well as superior characteristics such as:

(1) controlling of unevenness of display in the direction of signal electrode (normally vertical direction) and (2) not causing of especially severe uneven display in the direction of signal electrode nor flickering even when the display contents change one after another, and (3) prevention of occurrence of uneven display in the direction of scanning electrode (normally horizontal direction).

The electronic equipment based on the invention of the claim 16 is electronic equipment comprising a relatively inexpensive liquid crystal display device with superior display quality, hence, it is relatively inexpensive as a piece of electronic equipment providing an easy-to-see display screen and an easy-to-use piece of equipment for a user.

The driving circuit base on the invention according to claim 17 is structured to generate scanning signals to drive a liquid crystal display device such as that described above, and is an indispensable driving circuit for manufacturing manufacture such an excellent liquid crystal display device as described.

The driving circuit base on the invention according to claim 18 is structured to generate data signals to drive a liquid crystal display device such as described above, and is an indispensable driving circuit for the manufacture of such an excellent liquid crystal display device as described.

BRIEF DESCRIPTION OF THE DRAWINGS

FIG. 5 is a drawing illustrating the polarity of the selection signals in the fourth embodiment.

FIG. 6 is a drawing illustrating the polarity of the selection signals in the fifth embodiment.

FIG. 7 is a drawing illustrating the polarity of the selection signals in the sixth embodiment.

FIG. 8 is a drawing illustrating the polarity of the selection signals in the seventh embodiment.

FIG. 11 is a drawing illustrating the polarity of the selection signals in the tenth embodiment.

FIG. 14 is a drawing illustrating the polarity of the selection signals in the thirteenth embodiment.

DETAILED DESCRIPTION OF PREFERRED EMBODIMENTS

The present invention is described in greater detail hereafter with reference to the following embodiments and attached drawings.

In this section, a normally black type liquid crystal display device which turns black when voltage is not applied (off) to display elements and white when voltage is applied (on) to display elements is used as the liquid crystal display device; however, the present invention is not limited to a normally black type liquid crystal display devices but is applicable to a normally white type and other liquid crystal display devices as well.

Embodiment 1

Figure 20:
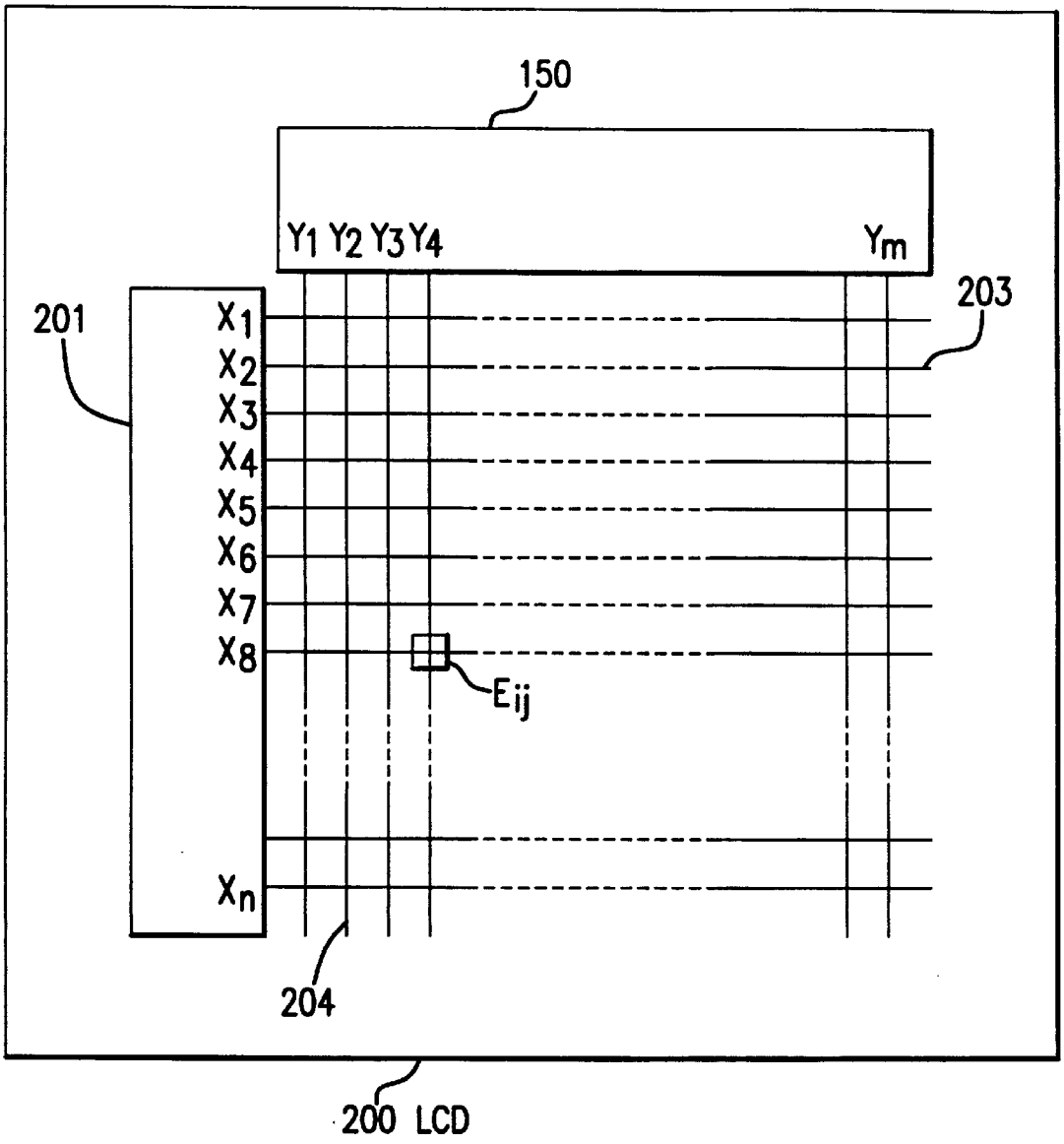
FIG. 20 is a drawing illustrating the structure of the conventional simple matrix type liquid crystal display device which is also used in the present invention.

FIG. 20 illustrates the structure of the liquid crystal display device (200) of an embodiment to which the present invention is applied. The liquid crystal display device is a simple matrix type liquid crystal display device comprising:

a plurality of scanning electrodes (203) to which scanning signals (X1–Xn) are applied to provide selection signals (V1 or −V1) for the selection period and non-selection signals (0V) for the non-selection period, a plurality of signal electrodes (204) to which data signals (Y1–Ym) are applied based on the display data, and display elements (Eij) which are driven by the scanning signals and data signals.

Figure 1:
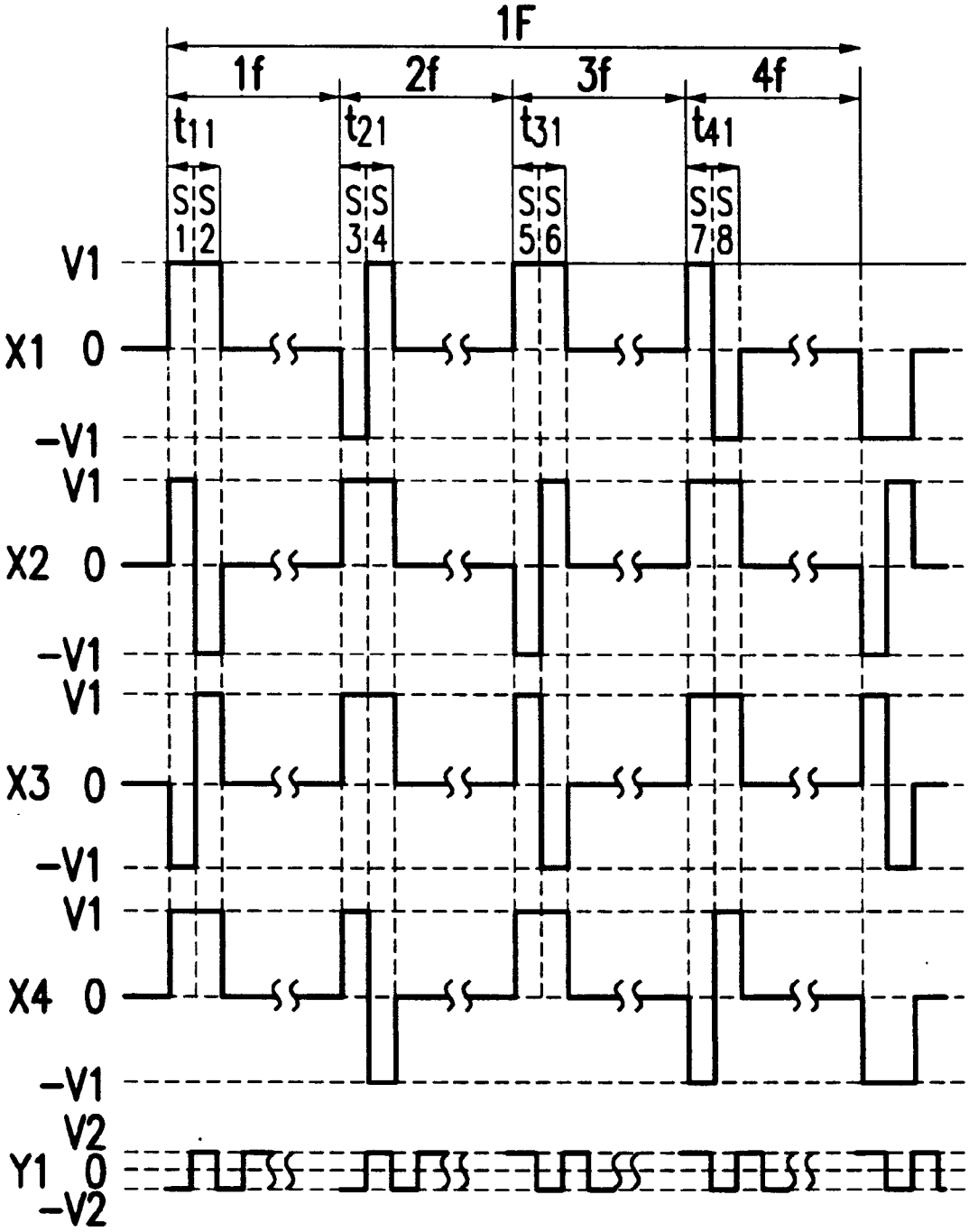
FIG. 1 is a drawing illustrating the driving wave pattern in the first embodiment (spikes in the voltage are omitted.)

FIG. 1 describes a driving method for the liquid crystal display device in the present embodiment.

Figure 21:
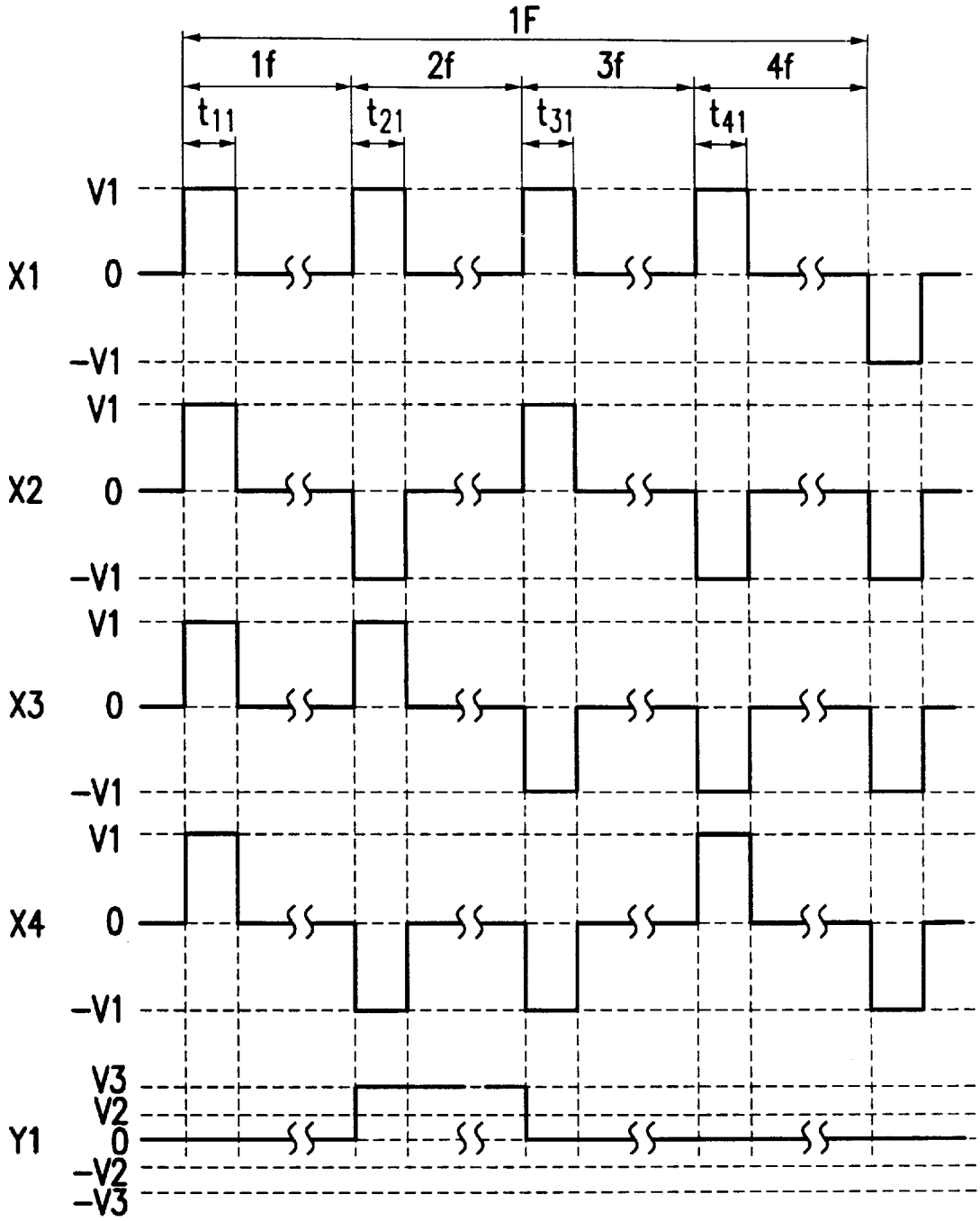
FIG. 21 is a drawing illustrating a conventional driving wave pattern.
Figure 22:
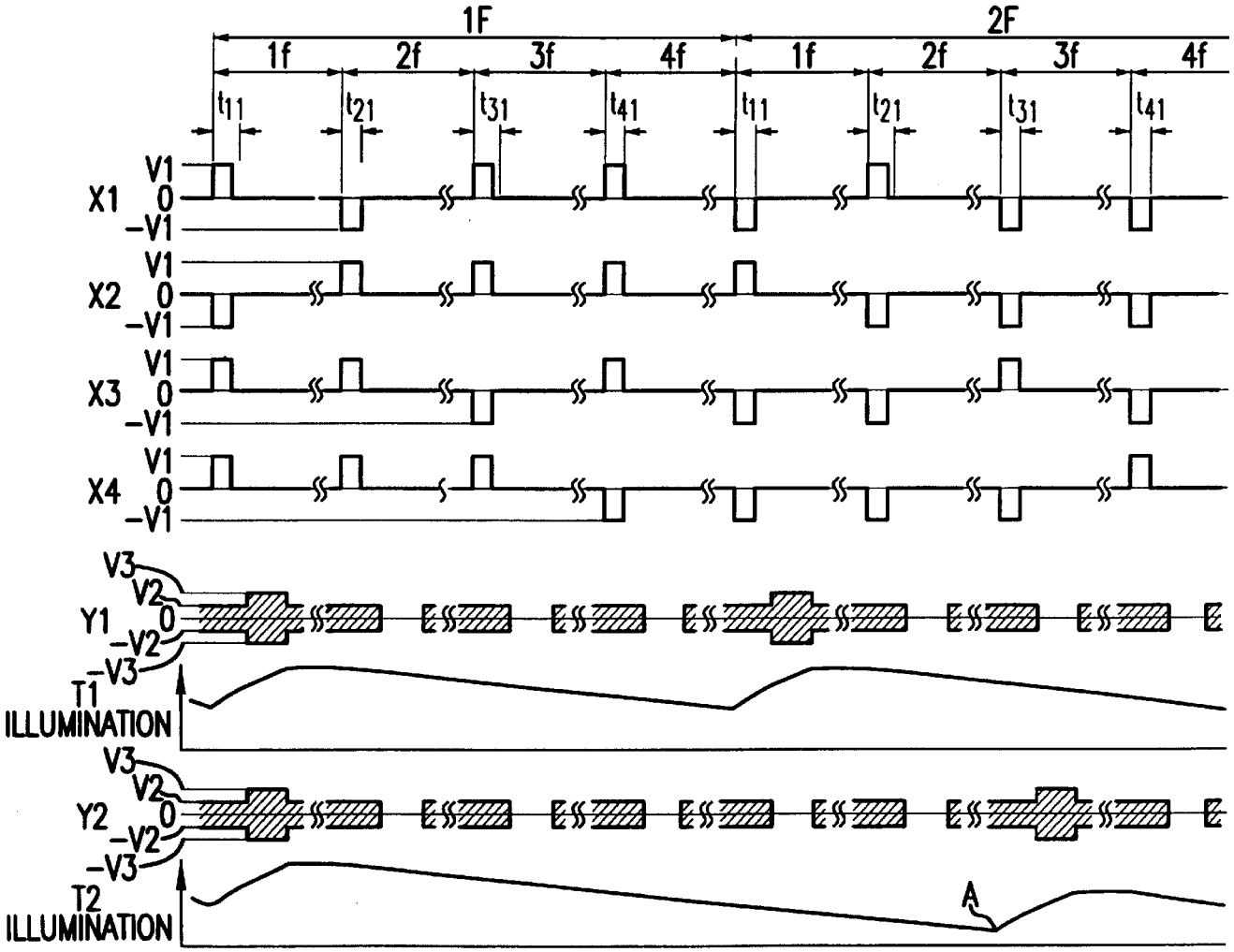
FIG. 22 is a drawing illustrating a conventional driving wave pattern and change in luminance.
Figure 23:
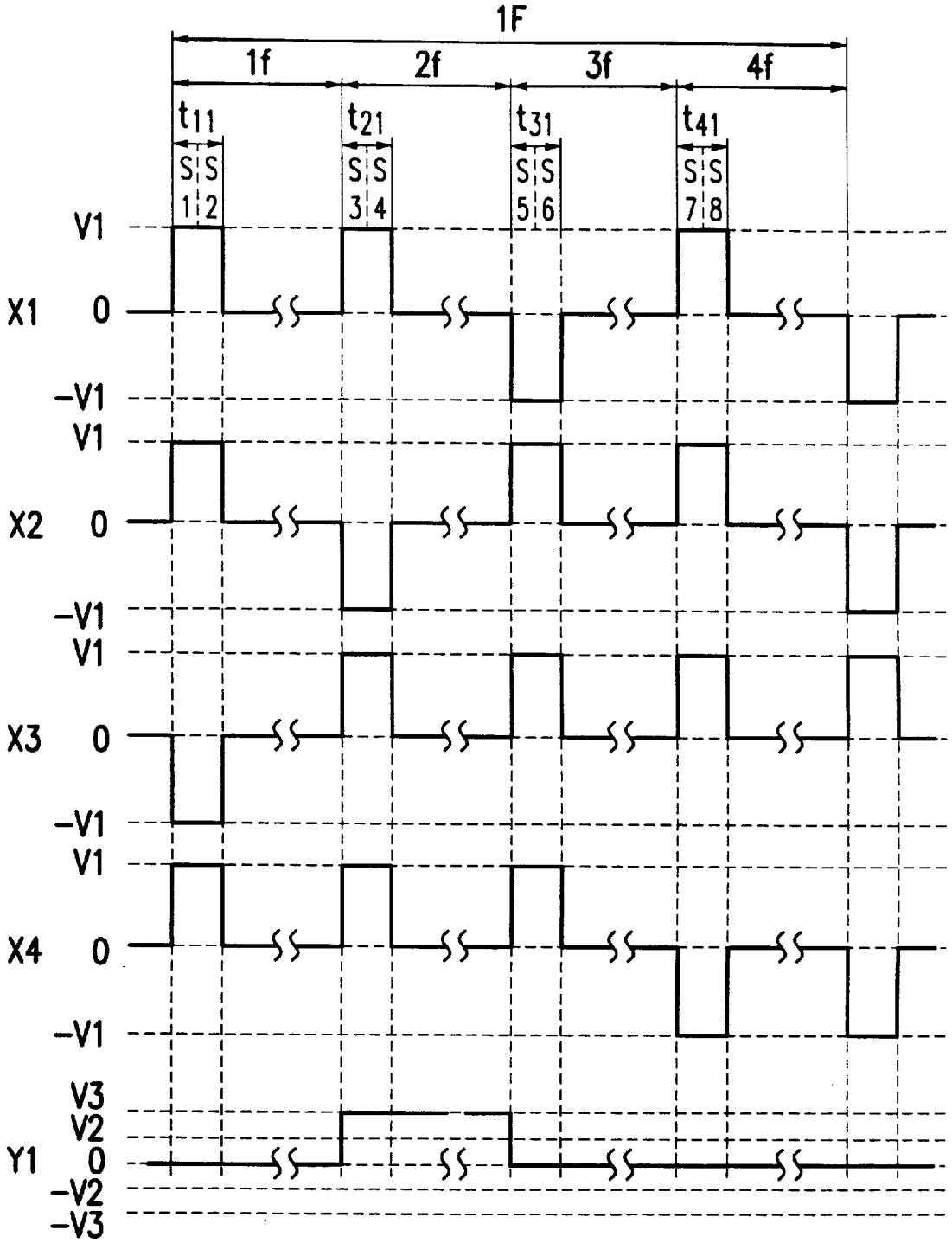
FIG. 23 is a drawing illustrating a conventional driving wave pattern.

Basically, the liquid crystal display device uses the same method as the multi-line driving method described in FIG. 21 through FIG. 23. The scanning electrodes are divided into groups of four and, selection signals mutually orthogonal in one frame are given in bulk to each of the scanning electrodes (X1–X4) belonging to the same group. Furthermore, the selection period is divided into four mutually separated sub-selection periods (t11–t41) with a electric potential for selection signal established for each of the selection periods. Data signals (Y1, Y2, . . . ) are determined based on a comparison between the polarity (+/–) of the electric potential of the selection signal based on the electric potential of the non-selection signals and the display data of the display elements.

However, the driving method for the liquid crystal display device in the present embodiment has the following merits which are not found in the conventional multi-line driving method described in FIGS. 21–23. In other words, in the present embodiment, each of the above-mentioned sub-selection periods (t11, t21, t31, t41) is further divided into two periods (hereafter "divided sub-selection period") ((s1, s2), (s3, s4), (s5, s6), (s7, s8)). Moreover, the electric potential of the selection signals are switched in the 8 divided sub-selection periods within one frame so that the effect of spikes in voltage from the scanning signals applied to the adjacent scanning voltage is eliminated within 8 periods (s1–s8).

The pattern of selection signals of the present embodiment can be produced from the driving wave pattern of a conventional multi-line driving method described in FIG. 23 as follows:

First, in the case of selection signal of X1 in FIG. 23, there are 8 divided sub-selection periods (s1–s8) in one frame and the electric potentials of 8 selection signals corresponding to these divided sub selection periods are denoted, in order, by Vs1, Vs2, . . . , Vs8.

Moreover, these 8 electric potentials Vs1–Vs8 are switched in 8 divided sub selection periods so that the order of 8 electric potentials becomes Vs1, Vs3, Vs5, Vs7, Vs4, Vs2, Vs8, Vs6, from the beginning of one frame.

Figure 2:
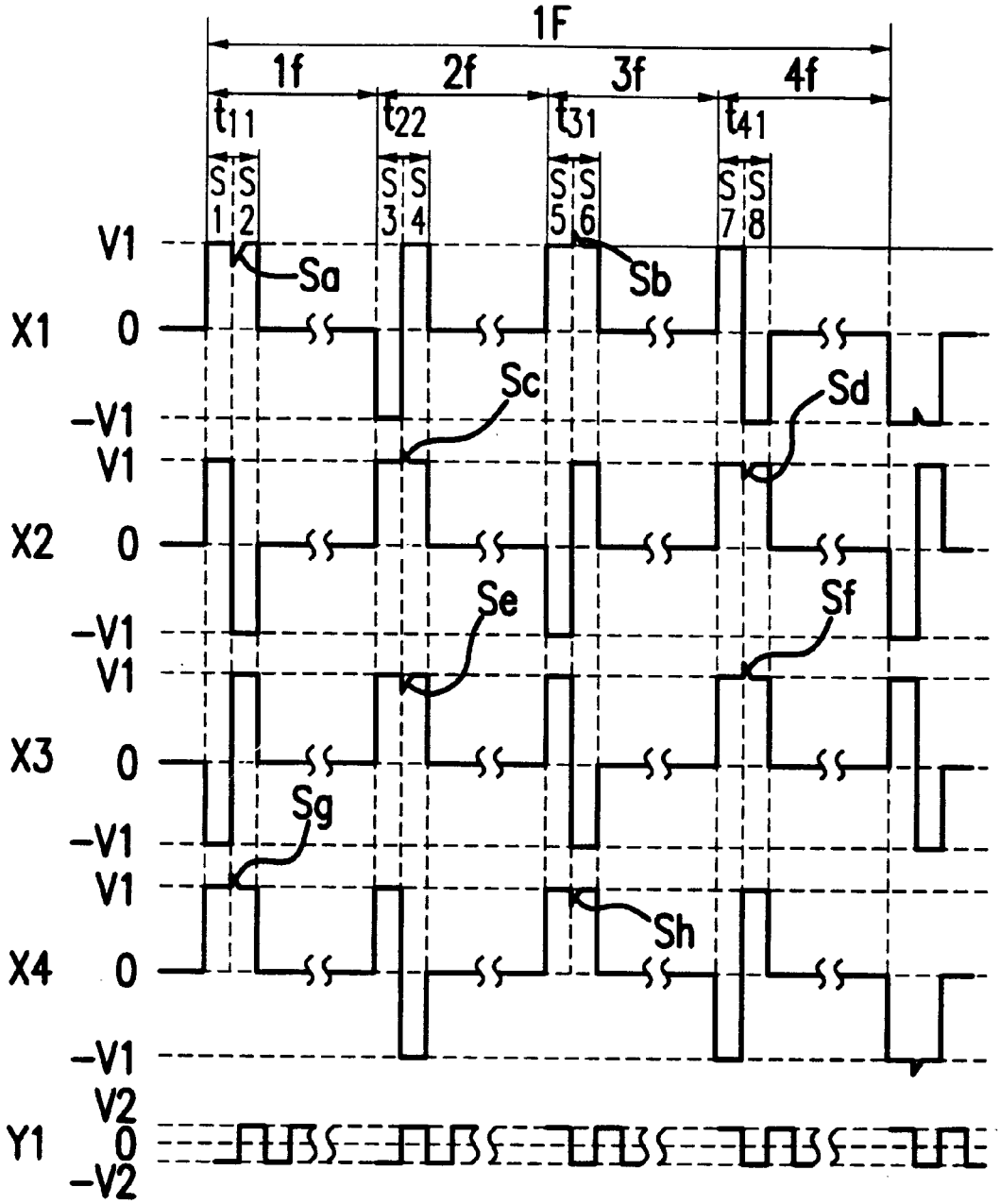
FIG. 2 is a drawing illustrating the driving wave pattern in the first embodiment (spikes in the voltage are not omitted.)

As a result, the driving method of the liquid crystal display device of the present embodiment can scatter and make uniform a shift in voltage applied to the display elements based on time and:

(1) controls unevenness of display in the direction of signal electrode (normally vertical direction) and (2) prevents especially severe uneven display in the direction of signal electrode nor flickering even when the display contents change one after another, and (3) the occurrence of uneven display in the direction of scanning electrode (normally horizontal direction) is prevented, by providing a structure wherein the electric potential of the selection signals in the plurality of periods to be appropriately switched, in order for the effect of spikes in voltage from the scanning signals applied to the adjacent scanning voltage to be eliminated within one frame, as illustrated in FIG. 2.

The reason for these merits is explained hereafter, with reference to FIG. 2. FIG. 2 illustrates the electric potential actually measured on the scanning electrodes when the scanning signals shown in FIG. 1 are output from the scanning electrode driver.

The electric potential of the scanning signal X1 switches from –V1 to +V1 when s3 is completed and s4 is started in the second field, and switches from +V1 to –V1 when s7 is completed and s8 is started in the fourth field. Moreover, the moment these switches take place, a spike in the voltage (Sc, Sd) occurs for the scanning signal X2 of the scanning electrode adjacent to the scanning electrode to which scanning electrode X1 is applied.

Similarly, the electric potential of the scanning signal X2 switches from +V1 to –V1 when s1 is completed and s2 is started in the first field, and switches from –V1 to +V1 when s5 is completed and s7 is started in the third field.

Moreover, the moment these switches take place, spikes in the voltage (Sa, Sb for X1, X3) occurs for the scanning signals X1 and X3 of the two scanning electrodes adjacent to the scanning electrode to which scanning electrode X2 is applied.

Similarly, the electric potential of the scanning signal X3 switches from –V1 to +V1 when s1 is completed and s2 is started in the first field, and switches from +V1 to –V1 when s5 is completed and s7 is started in the third field.

Moreover, the moment these switches take place, spikes in the voltage (X2, Sg, Sh for X4) occur for the scanning signals X2 and X4 of the two scanning electrodes adjacent to the scanning electrode to which scanning electrode X3 is applied.

Similarly, the electric potential of the scanning signal X4 switches from +V1 to –V1 when s3 is completed and s4 is started in the second field, and switches from –V1 to +V1 when s7 is completed and s8 is started in the fourth field.

Moreover, the moment these switches take place, spikes in the voltage (Se, Sf) occur for the scanning signal X3 of the scanning electrode adjacent to the scanning electrode to which scanning electrode X4 is applied.

Such spikes in the voltage cause differences in the effective voltage to be applied to the display elements, resulting in a horizontal, uneven display. However, in the case of FIG. 2, the polarities of spikes in the voltage Sa and Sb, Sc and Sd, Se and Sf, and Sg and Sh are opposite, cancelling each other. In other words, the effect of spikes in the voltage from the scanning signals which are applied to the adjacent scanning electrodes is eliminated within one frame. As a result, (3) the unevenness in the display in the horizontal direction (direction of the scanning electrode) is effectively prevented.

Hereafter, conditions will be explained in which a structure is not provided wherein the effect of spikes in the voltage from the scanning signals which are applied to adjacent scanning electrodes is eliminated within one frame.

The pattern of selection signals in FIG. 23 can be produced from the driving wave pattern of a conventional multi-line driving method illustrated in FIG. 23 as follows. First, in the case of selection signal of X1 in the FIG. 23, there are 8 divided sub-selection periods (s1–s8) in one frame and the electric potentials of 8 selection signals corresponding to these divided sub selection periods are denoted, in order, by Vs1, Vs2, . . . , Vs8. Moreover, these 8 electric potentials Vs1–Vs8 are switched in 8 divided sub selection periods so that the order of 8 electric potentials becomes Vs1, Vs3, Vs5, Vs7, Vs2, Vs4, Vs6, Vs8, from the beginning of one frame.

As a result, spikes in voltage occur in four scanning electrodes Sa, Sb, Sc and Sd to be selected first and are not offset by each other since the polarity of spikes in voltage of Sa and Sb, and Sc and Sd are the same. In other words, the effect of spikes in voltage from the scanning signals to be applied to adjacent scanning electrodes is not eliminated within one frame. Hence, a shift in voltage applied to the display elements based on time can be made uniform and (1) unevenness of display in the direction of signal electrode (normally vertical direction) may be controlled, and (2) especially severe uneven display in the direction of signal electrode nor flickering may not be caused even when the display contents change one after another but (3) unevenness in the display in the horizontal direction (direction of the scanning electrode) is not effectively prevented.

In the present embodiment, the scanning electrodes are divided into groups of four, but the present invention can equally be applied to cases when they are divided into groups of two, three, five, six, or any arbitrary number as long as the selection signals which are mutually orthogonal in one frame are given in bulk to the scanning electrodes belonging to the same group.

Moreover, the selection period in one frame is divided into 4 mutually separated sub selection periods in the present embodiment but it is not limited to 4 and 8, and 16 or an arbitrary number also can be used equally effectively.

In the present embodiment, selection signals mutually orthogonal in one frame are used but the period of orthogonality is not limited to one frame and the present invention can be effectively applied to another period.

Furthermore, in the present embodiment, each sub-selection period is divided into 2 divided sub-selection periods in order to reduce the electric current consumption of the liquid crystal display device using a relatively simple and low driving frequency driving wave pattern, but it is not limited to 2. The larger the number of divisions is, the stronger becomes the effect that:

(1) unevenness of display in the direction of signal electrode (normally vertical direction) is controlled, and (2) especially severe uneven display in the direction of signal electrode and flickering are not caused even when the display contents change one after another.

In this case also, q should be even to eliminate the horizontal uneven display completely, but even if q is odd, horizontal uneven display can be controlled for practical purposes if q is not smaller than 3.

The driving method of the present embodiment prevents uneven display caused by non-uniformity of liquid crystal cells between the boards and, in order to extend the longevity of the liquid crystal panel, it reverses the polarity of the voltage applied to display elements for each frame but the reversal period is not limited to one frame and similar effects can be obtained if the polarity is reversed for one field at a time, several fields, or several frames at a time.

Embodiment 2

Figure 3:
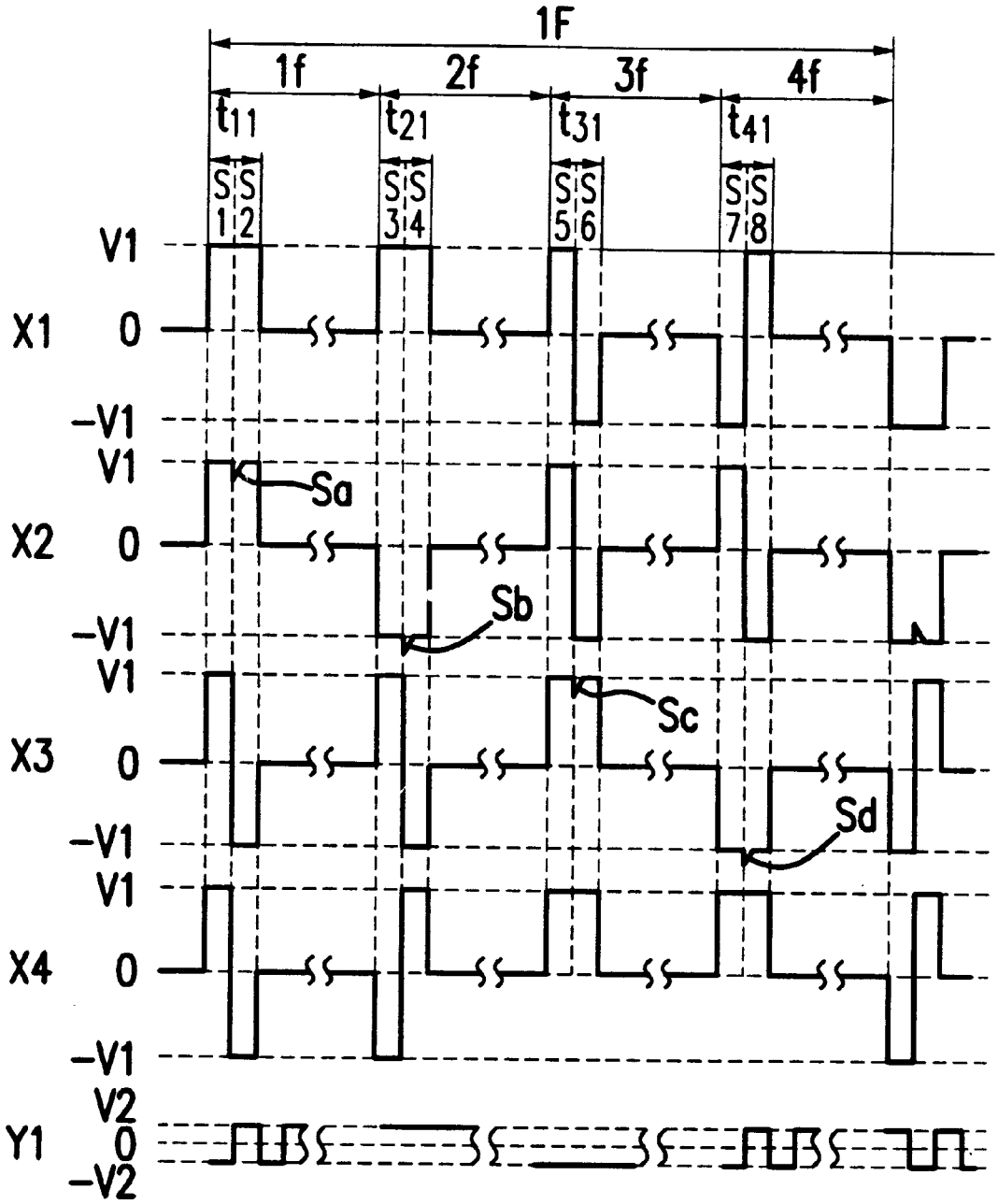
FIG. 3 is a drawing illustrating the driving wave pattern in the second embodiment.

FIG. 3 illustrates a driving method of the liquid crystal display device in the present embodiment, which has a similar effect as the driving method of the liquid crystal display device in embodiment 1.

In other words, the driving method of the liquid crystal display device in the present embodiment, in a manner similar to the liquid crystal display device in embodiment 1, can accomplish a uniform shift in voltage applied to the display elements based on time and (1) controls unevenness of the display in the direction of the signal electrode (normally vertical direction) and (2) does not cause especially severe uneven display in the direction of signal electrode nor flickering even when the display contents change one after another. In addition, Sa and Sb, and Sc and Sd have the spikes in voltage with opposite polarity which offsets each other hence (3) effectively prevents unevenness in the display in the horizontal direction (direction of the scanning electrode).

Embodiment 3

Figure 4:
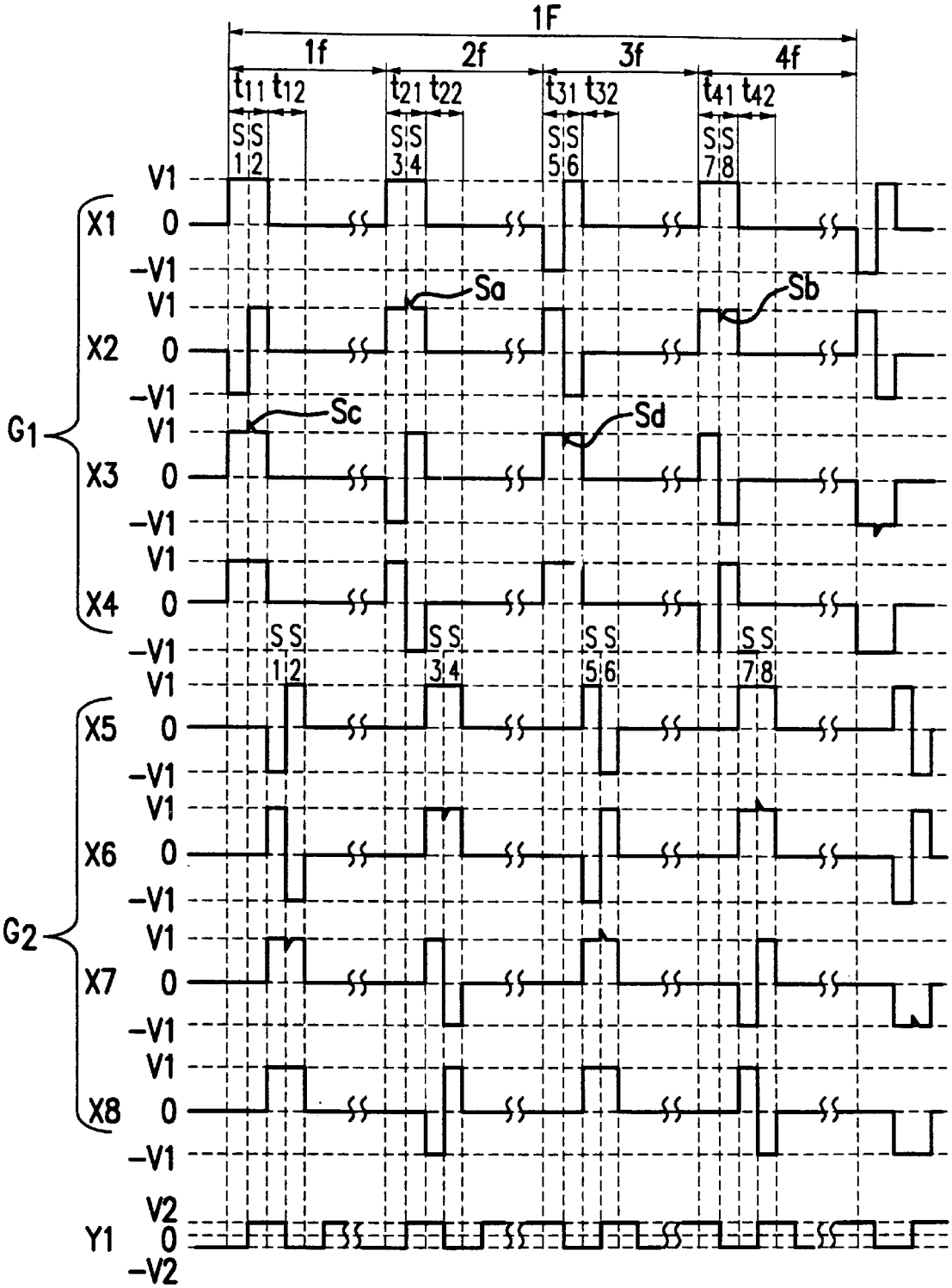
FIG. 4 is a drawing illustrating the driving wave pattern in the third embodiment.

FIG. 4 illustrates a driving method of the liquid crystal display device in the present embodiment.

The driving method of the liquid crystal display device in the present embodiment is suitable as a liquid crystal display device when the voltage applied to display elements is not reversed in the same field.

Moreover: the polarity based on the electric potential of the non-selection signal of the electric potential of selection signals to be applied to the last divided sub-selection period (s2) out of the 2 divided sub-selection periods (s1, s2) in the sub-selection period (t11, for example) out of selection signals to be applied to certain scanning electrode belonging to a certain group (G1, for example), and the polarity based on the electric potential of the non-selection signal of the electric potential of selection signals to be applied to the first divided sub-selection period (s1) out of the 2 divided sub-selection periods (s1, s2) in the sub-selection period (t12) out of selection signals to be applied to the scanning electrode corresponding to the certain scanning electrode out of scanning electrodes belonging to a group (G2, for example) to be selected as the next group are made to have the same sign.

As a result, the driving method of the liquid crystal display device in the present embodiment demonstrates the same effects as embodiment 1 and embodiment 2 wherein (1) unevenness of display in the direction of signal electrode (normally vertical direction) is controlled, (2) especially severe uneven display in the direction of signal electrode and flickering are not caused even when the display contents change one after another, and (3) the occurrence of uneven display in the direction of scanning electrode (normally horizontal direction) is prevented.

In addition, it has a merit that the number of switchings between off and on of the data signals can be reduced, enabling a lowering of electric current consumption because both the character display and the image display repeat much of the contents of the display having the same pattern on the same signal electrode. (compare Y1 in FIG. 2 and Y1 in FIG. 4)

The pattern of selection signals for the present embodiment can be produced from the driving wave pattern of a conventional multi-line driving method illustrated in FIG. 23 as follows:

First, in the case of selection signal of X1 in the FIG. 23, there are 8 divided sub-selection periods (s1–s8) in one frame and the electric potentials of 8 selection signals corresponding to these divided sub selection periods are denoted, in order, by Vs1, Vs2, . . . , Vs8.

Moreover, these 8 electric potentials Vs1–Vs8 are switched in 8 divided sub selection periods in the present embodiment so that the order of 8 electric potentials becomes Vs3, Vs5, Vs1, Vs7, Vs6, Vs4, Vs8, Vs2, from the beginning of one frame.

Moreover, for scanning signals X5–X8: the electric potential Vs1 of s1 of X5 and the electric potential Vs2 of s2 of X1 are made to have the same polarity, for example, the electric potential Vs3 of s3 of X5 and the electric potential Vs4 of s4 of X1 are made to have the same polarity, the electric potential Vs5 of s5 of X5 and the electric potential Vs6 of s6 of X1 are made to have the same polarity, and the electric potential Vs7 of s7 of X5 and the electric potential Vs8 of s8 of X1 are made to have the same polarity.

Similarly, scanning signals X6–X8 are made from the scanning signals X2–X4 and the scanning signals X9–X12 are made from X5–X8.

The driving method of the present embodiment prevents uneven display caused by non-uniformity of liquid crystal cells between plates and in order to extend the longevity of the liquid crystal panel it reverses the polarity of the voltage applied to the display elements for each frame. However, the reversal period is not limited to one frame and similar effects can be obtained if the polarity is reversed for one field at a time, several fields, or several frames at a time.

Embodiment 4

FIG. 5 illustrates the driving method of the liquid crystal display device in the present embodiment.

The driving method of the liquid crystal display device in the present embodiment demonstrates the same effects as embodiment 3 wherein (1) unevenness of display in the direction of signal electrodes (normally vertical direction) is controlled, (2) especially severe uneven display in the direction of signal electrodes and flickering are not caused even when the display contents change one after another, and (3) occurrence of uneven display in the direction of scanning electrodes (normally horizontal direction) is prevented because effects of spikes in voltage from the scanning signals to be applied to adjacent scanning electrode is eliminated in one frame.

Here, G1, G2, G3 and G4 denote the scanning electrode groups which are selected simultaneously. Moreover, X1–X16 denote the scanning signals to be applied to first scanning electrode to 16th scanning electrode, which is the same as the case in FIG. 4. Furthermore, 1*f*, 2*f*, 3*f* and 4*f* represent the first field, second field, third field and fourth field, respectively, which is the same as FIG. 4. + and − denote the polarity based on the electric potential of non-selection signals of the electric potential of each selection signal. In the case of the present embodiment, the electric potential of the non-selection signal is 0V, hence the polarity becomes + if the electric potential of selection signal is +V1 and − if it is −V1.

Embodiment 5

FIG. 6 illustrates the driving method of the liquid crystal display device in the present embodiment.

The driving method of the liquid crystal display device in the present embodiment demonstrates the same effects as embodiment 3 wherein:

(1) unevenness of display in the direction of signal electrode (normally vertical direction) is controlled, (2) especially severe uneven display in the direction of signal electrode and flickering are not caused even when the display contents change one after another, and (3) occurrence of uneven display in the direction of scanning electrode (normally horizontal direction) is prevented because effect of spikes in voltage from the scanning signals to be applied to adjacent scanning electrode is eliminated in one frame.

Here, in the case of present embodiment, there are 6 scanning electrodes selected simultaneously and scanning signals X1–X6, X7–X12, X13–X18, X19–X24 correspond to each group (G1–G4). Moreover, 8 sub-selection periods are included in one frame.

Embodiment 6

FIG. 7 illustrates the driving method of the liquid crystal display device in the present embodiment demonstrates the same effects as embodiment 3 wherein:

(1) unevenness of display in the direction of signal electrode (normally vertical direction) is controlled, (2) especially severe uneven display in the direction of signal electrode and flickering are not caused even when the display contents change one after another, and (3) the occurrence of an uneven display in the direction of scanning electrode (normally horizontal direction) is prevented because effect of spikes in voltage from the scanning signals to be applied to adjacent scanning electrode is eliminated in one frame.

In addition, the driving method of the liquid crystal display device in the present embodiment reverses the voltage applied to each display element at the second field and the third field.

As a result, the driving method of the liquid crystal display device of the present invention has the effect of controlling an uneven display caused by unevenness between the liquid crystal cell plates at the same time, extending the longevity of the liquid crystal panel.

Embodiment 7

FIG. 8 illustrates the driving method of the liquid crystal display device in the present embodiment.

The driving method of the liquid crystal display device in the present embodiment provides two cases in which:

the polarity of the electric potential to be applied to the display elements selected by the selection signals to be applied to certain scanning electrodes belonging to a certain group, and the polarity of the electric potential to be applied to display elements selected by the selection signals to be applied to the scanning electrodes belonging to a group to be selected as the next group and corresponding to the certain scanning electrode are not reversed in the same field (G1 and G2, G3 and G4), and are reversed in the same field (G2 and G3).

In the case in which two polarities are not reversed:

the polarity based on the electric potential of the non-selection signal of the electric potential of selection signals to be applied to the last divided sub-selection period (s2) out of the 2 divided sub-selection periods (s1, s2) in the sub-selection period (t11, for example) out of selection signals to be applied to certain scanning electrode belonging to certain group (G1, for example), and the polarity based on the electric potential of the non-selection signal of the electric potential of selection signals to be applied to the first divided sub-selection period (s1) out of the 2 divided sub-selection periods (s1, s2) in the sub-selection period (t12) out of selection signals to be applied to the scanning electrode corresponding to the certain scanning electrode out of scanning electrodes belonging to a group (G2, for example) to be selected as the next group, are made to have the same sign.

As a result, the driving method of the liquid crystal display device has the effect of (1) controlling unevenness of display in the direction of signal electrode (normally vertical direction), (2) not causing especially severe uneven display in the direction of signal electrode and flickering even when the display contents change one after another, and (3) preventing the occurrence of an uneven display in the direction of scanning electrode (normally horizontal direction).

In addition uneven display caused by unevenness between the liquid crystal cell plates is controlled and the number of off/on switching of data signals (Y1, Y2, . . . ) can be reduced even when commonly known polarity reversal is executed for a plurality of scanning lines as a unit to extend longevity of the liquid crystal panel, resulting in lowering of electric current consumption by the liquid crystal display device.

Embodiment 8

Figure 9:
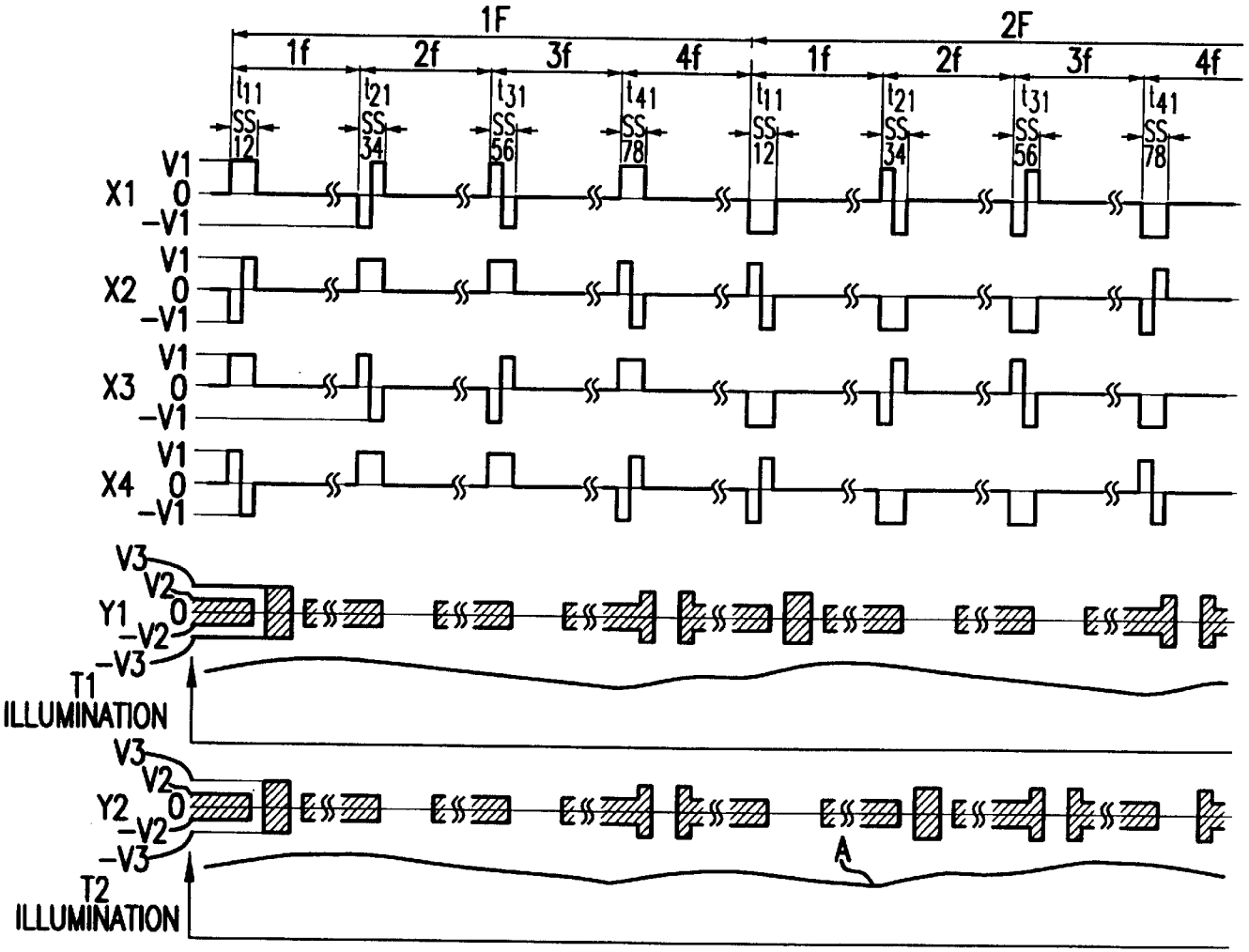
FIG. 9 is a drawing illustrating the driving wave pattern and corresponding change in the luminance of display elements in the eighth embodiment.

FIG. 9 illustrates the driving method of the liquid crystal display device in the present embodiment.

The driving method of the liquid crystal display device in the present embodiment has the order of the pattern of the appearance of the electric potential being reversed between:

the selection signals given during the first 4 divided sub-selection periods and the selection signals given during the last 4 divided sub-selection periods out of 8 divided sub-selection periods of one frame.

The pattern of selection signals of the present embodiment can be produced from the driving wave pattern of a conventional multi-line driving method described in FIG. 23 as follows:

First, in the case of selection signal of X1 in the FIG. 23, there are 8 divided sub-selection periods (s1–s8) in one frame and the electric potentials of 8 selection signals corresponding to these divided sub-selection periods are denoted, in order, by Vs1, Vs2, . . . , Vs8.

Moreover, in the present embodiment these 8 electric potentials Vs1–Vs8 are switched in 8 divided sub-selection periods so that the order of 8 electric potentials becomes Vs3, Vs7, Vs5, Vs1, Vs2, Vs6, Vs8, Vs4, from the beginning of one frame.

FIG. 9 also illustrates the manner in which luminance (T1, T2) of display elements change one after another with voltage applied to the display elements. As a comparison with the driving method of conventional liquid crystal display device in FIG. 22 clearly indicates, a change in luminance (T2) is eased even when the display screen changes between a first frame and a second frame, preventing especially severe unevenness of display in the direction of the signal electrode and occurrence of flickering.

This is caused because:

even when the contents of display change between 1F period and 2F period like data signal Y2, the luminance of the pixels does not change drastically because the part with ±V3 existing between 1*f* period and 4*f* period of 1F period moves to between 2*f* and 3*f* period of 2F period, and the pixel luminance is bright during 1*f* period of 1F, becomes gradually dark over 2*f*–3*f* period, becomes bright during 4*f* period, becomes dark during 1*f* period of 2F, and becomes gradually bright over 2*f*–3*f* periods.

This effect is clearly seen if the luminance is compared between location A in FIG. 22 and the location A in FIG. 9.

As described above, the driving method of the liquid crystal display device in the present embodiment can scatter and make uniform a shift in voltage applied to the display elements based on time, strengthening further (1) the controlling of unevenness of display in the direction of signal electrode (normally vertical direction) and (2) not causing of especially severe uneven display in the direction of signal electrodes and flickering even when the display contents change one after another.

Moreover, the effect of spikes in voltage from the scanning signals applied to the adjacent scanning voltage is eliminated completely within one frame, and (3) the occurrence of uneven display in the direction of scanning electrode (normally horizontal direction) is prevented.

Here, the polarity of voltages to be applied to display elements is not reversed between the first field (1*f*) and second field (2*f*) in the present embodiment, but obviously, the polarity can be reversed.

Embodiment 9

Figure 10:
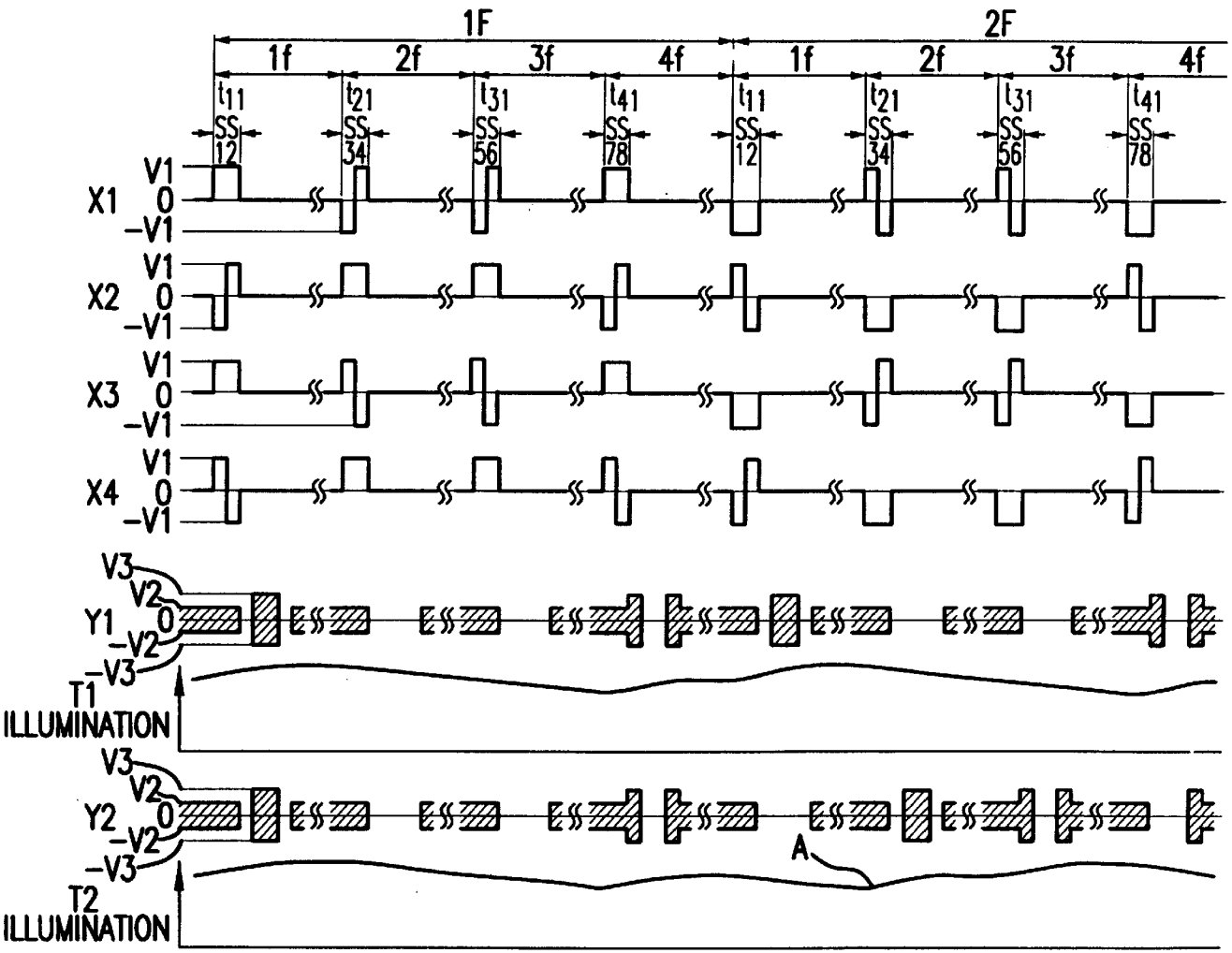
FIG. 10 is a drawing illustrating the driving wave pattern and the corresponding change in the luminance of display elements in the ninth embodiment.

FIG. 10 illustrates the driving method of the liquid crystal display device in the present embodiment.

The pattern of selection signals of the present embodiment is produced from the driving wave pattern of a conventional multi-line driving method illustrated in FIG. 23 as follows:

First, in the case of selection signal of X1 in FIG. 23, there are 8 divided sub-selection periods (s1–s8) in one frame and the electric potentials of 8 selection signals corresponding to these divided sub-selection periods are denoted, in order, by Vs1, Vs2, . . . , Vs8.

Moreover, these 8 electric potentials Vs1–Vs8 are switched in 8 divided sub-selection periods so that the order of 8 electric potentials becomes Vs3, Vs7, Vs5, Vs1, Vs6, Vs2, Vs4, Vs8, from the beginning of one frame.

Hence, the driving method of the liquid crystal display device in the present embodiment has a structure in which:

the order of the pattern of the appearance of the electric potential is reversed between the selection signals given during the first 4 divided sub-selection periods and the selection signals given during the last 4 divided sub-selection periods in one frame and, the order of the pattern of the appearance of the electric potential of selection signal is reversed during the same sub-selection periods ((s5, s6) or (s7, s8)) in the last 4 divided sub-selection signal periods.

FIG. 10 also illustrates the manner in which luminance (T1, T2) of display elements change one after another with voltage applied to the display elements. Similar to the embodiment 8, a change in luminance (T2) is eased even when the display screen changes between a first frame and a second frame, preventing especially severe unevenness of display in the direction of the signal electrodes and occurrence of flickering.

This is caused by the fact that:

even when the contents of display change between the 1F period and the 2F period like data signal Y2, luminance of the pixels does not change drastically because the part with ±V3 existing between the 1*f* period and the 4*f* period of the 1F period moves to between the 2*f* and the 3*f* period of the 2F period, and the pixel luminance is bright during 1*f* period of 1F, becomes gradually dark over 2*f*–3*f* period, becomes bright during 4*f* period, becomes dark during 1*f* period of 2F, and becomes gradually bright over 2*f*–3*f* periods.

As described above, the driving method of the liquid crystal display device in the present invention, though unable to (3) control uneven display in the direction of the scanning electrodes (normally horizontal direction), is capable of making uniform a shift of voltage applied to display element based on time, hence has effect of:

(1) controlling of unevenness of display in the direction of signal electrode (normally vertical direction) and (2) not causing especially severe uneven display in the direction of signal electrodes and flickering even when the display contents change one after another, thus contributing to increased degree of freedom in determining selection signals and to enriching of the technological capabilities.

Here, the polarity of voltages to be applied to display elements is not reversed between the first field (1*f*) and the second field (2*f*) in the present embodiment, but obviously, the polarity can be reversed.

Embodiment 10

FIG. 11 illustrates the driving method of the liquid crystal display device in the present embodiment.

The driving method of the liquid crystal display device in the present embodiment is a driving method in which six scanning electrodes are selected simultaneously.

The order of the pattern of the appearance of the electric potential is reversed between the selection signals given during the first 8 divided sub-selection periods and the selection signals given during the last 8 divided sub-selection periods out of 16 divided sub-selection periods of one frame.

As a result, the driving method of the liquid crystal display device in the present embodiment has the same effect as the driving method of the liquid crystal display device in embodiment 8.

Embodiment 11

Figure 12:
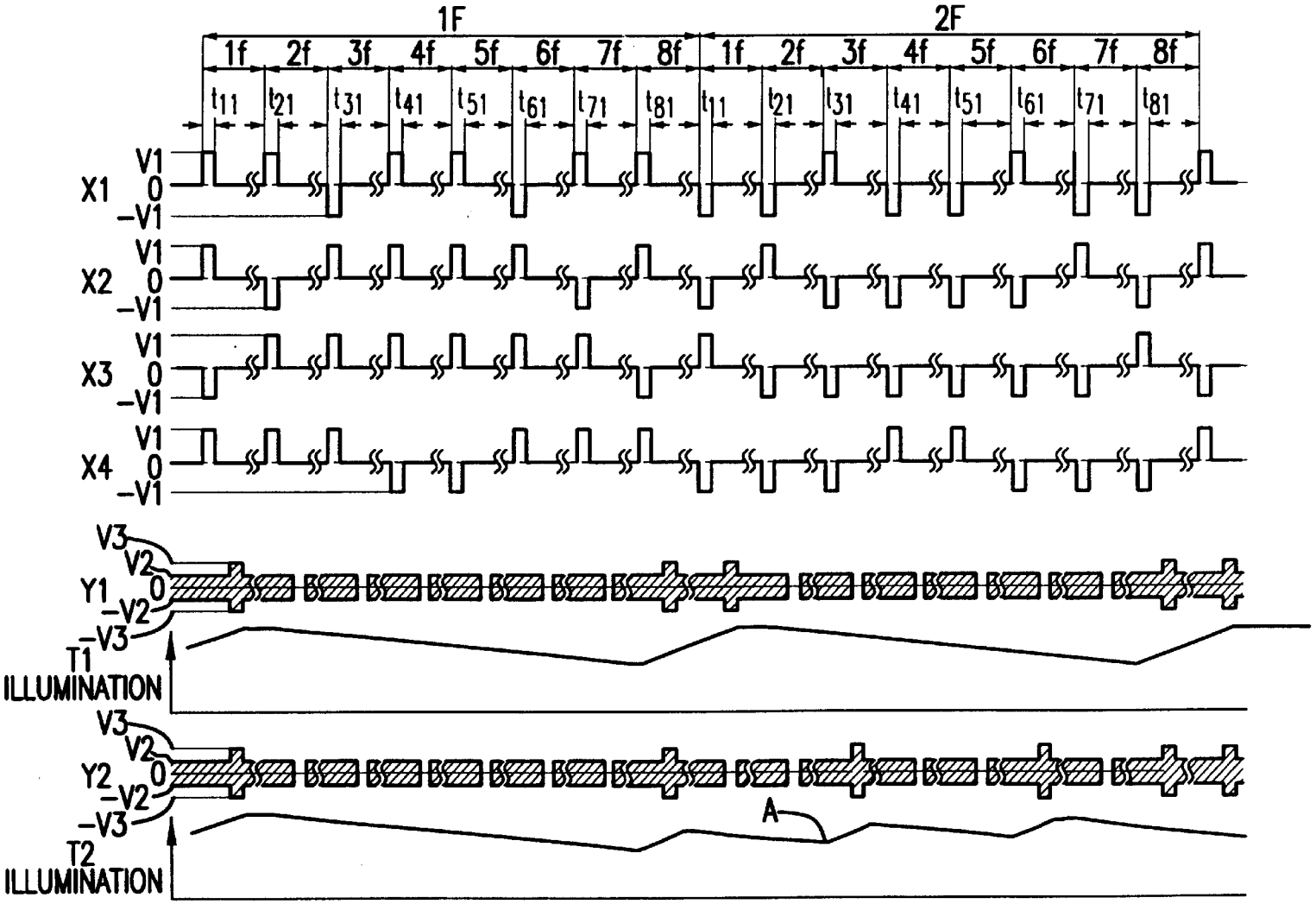
FIG. 12 is a drawing illustrating the driving wave pattern and corresponding change in the luminance of display elements in the eleventh embodiment.

FIG. 12 illustrates the driving method of the liquid crystal display device in the present embodiment.

In addition to the order of the pattern of the appearance of the electric potential being reversed between the selection signals given during the first 4 divided sub-selection periods and the selection signals given during the last 4 divided sub-selection periods out of 8 divided sub-selection periods of one frame, the 8 divided sub-selection period is mutually separated.

The pattern of selection signals of the present embodiment can be produced from the driving wave pattern of a conventional multi-line driving method described in FIG. 23 as follows:

First, in the case of selection signal of X1 in the FIG. 23, there are 8 divided sub-selection periods (s1–s8) in one frame and the electric potentials of 8 selection signals corresponding to these divided sub-selection periods are denoted, in order, by Vs1, Vs2, . . . , Vs8.

Moreover, these 8 electric potentials Vs1–Vs8 are switched in 8 divided sub-selection periods so that the order of 8 electric potentials becomes Vs1, Vs3, Vs5, Vs7, Vs8, Vs6, Vs4, Vs2, from the beginning of one frame.

As a result, the driving method of the liquid crystal display device in the present embodiment has the following effect, in addition to the effect of the driving method of the liquid crystal display device in embodiment 8.

First, by mutually separating all the divided sub-selection periods, a shift of voltage applied to display elements based on time is made more uniform and is capable of responding to a liquid crystal with a high speed response, making the present embodiment especially suitable for driving method of the liquid crystal display device with high speed response.

Embodiment 12

Figure 13:
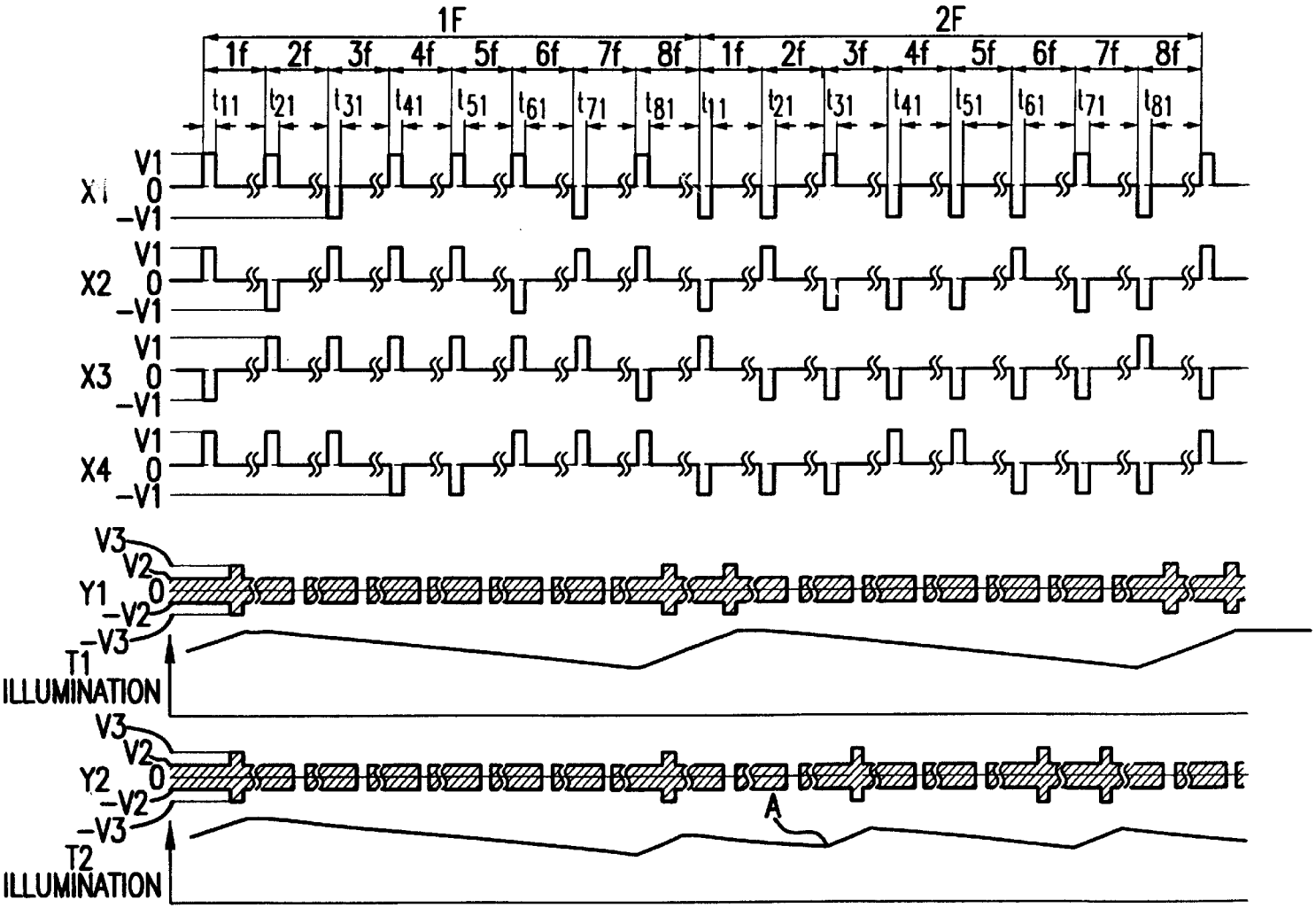
FIG. 13 is a drawing illustrating the driving wave pattern and corresponding change in the luminance of display elements in the twelfth embodiment.

FIG. 13 illustrates the driving method of the liquid crystal display device in the present embodiment.

In addition to the order of the pattern of the appearance of the electric potential being reversed between the selection signals given during the first 4 divided sub-selection periods and the selection signals given during the last 4 divided sub-selection periods out of 8 divided sub-selection periods of one frame, the sixth electric potential is switched with the seventh electric potential and the 8 divided sub-selection period is mutually separated.

The pattern of selection signals of the present embodiment can be produced from the driving wave pattern of a conventional multi-line driving method described in FIG. 23 as follows:

First, in the case of selection signal of X1 in the FIG. 23, there are 8 divided sub-selection periods (s1–s8) in one frame and the electric potentials of 8 selection signals corresponding to these divided sub-selection periods are denoted, in order, by Vs1, Vs2, . . . , Vs8.

Moreover, these 8 electric potentials Vs1–Vs8 are switched in 8 divided sub-selection periods so that the order of 8 electric potentials becomes Vs1, Vs3, Vs5, Vs7, Vs8, Vs4, Vs6, Vs2, from the beginning of one frame.

As a result, the driving method of the liquid crystal display device in the present embodiment can prevent uneven display in the horizontal direction caused by spikes in the voltage. In addition, it can make uniform a shift of voltage applied to display element based on time, hence has effects of:

(1) controlling of unevenness of display in the direction of signal electrode (normally vertical direction) and (2) not causing of especially severe uneven display in the direction of signal electrode and flickering even when the display contents change one after another.

Moreover, the present embodiment is capable of responding to liquid crystal with high speed response, making it especially suitable for driving method of the liquid crystal display device with high speed response.

Embodiment 13

FIG. 14 illustrates the driving method of the liquid crystal display device in the present embodiment.

The driving method of the liquid crystal display device in the present embodiment is a driving method in which six scanning electrodes are selected simultaneously.

The order of the pattern of the appearance of the electric potential is reversed between the selection signals given during the first 8 divided sub-selection periods and the selection signals given during the last 8 divided sub-selection periods out of 16 divided sub-selection periods of one frame.

As a result, the driving method of the liquid crystal display device in the present embodiment has the same effect as the driving method of the liquid crystal display device in embodiment 11. Moreover, the present embodiment is capable of responding to liquid crystal with high speed response, making it especially suitable for driving method of the liquid crystal display device with high speed response.

Embodiment 14

Figure 15:
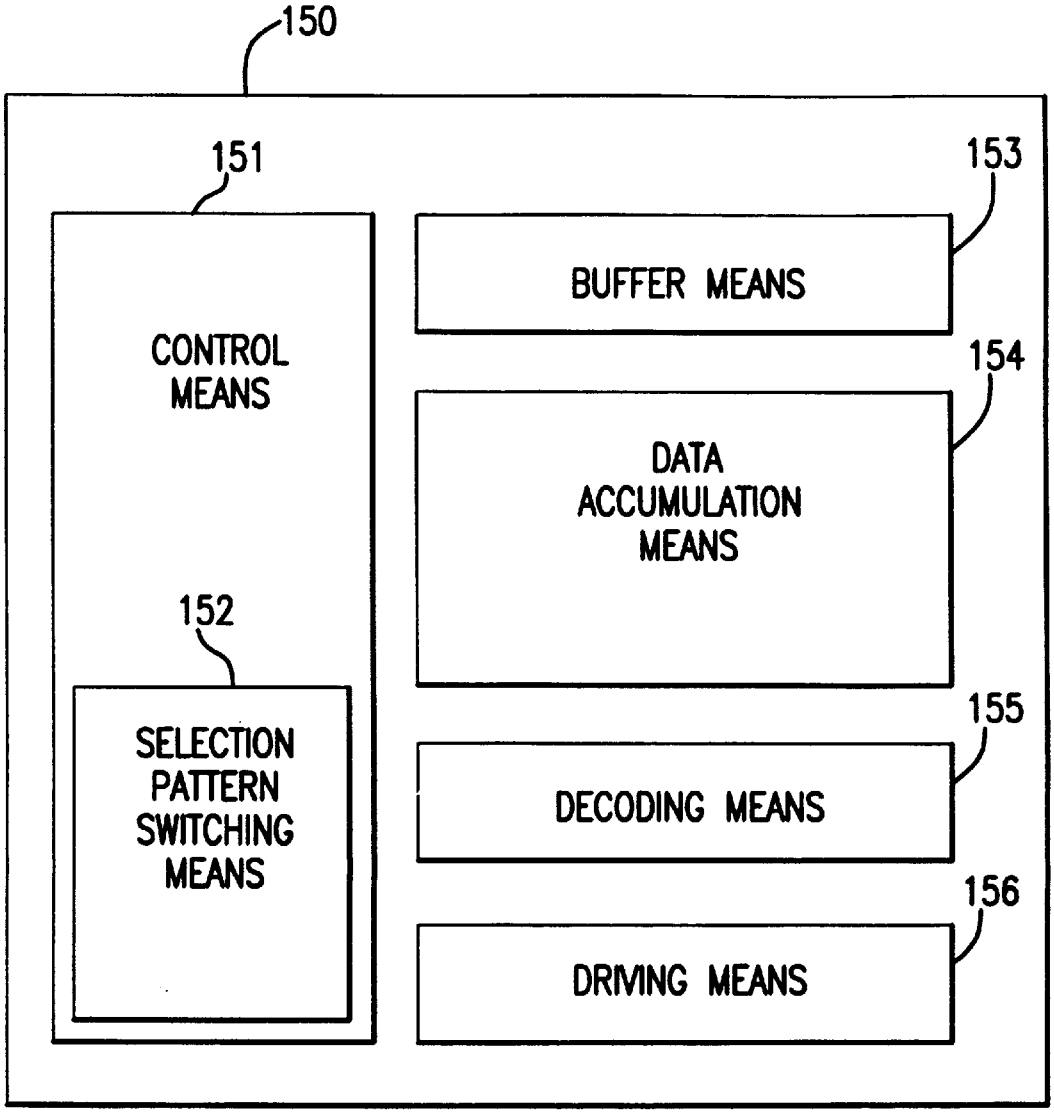
FIG. 15 is a drawing illustrating a structure of the data driver in the fourteenth embodiment.

FIG. 15 illustrates a data driver to be used in the driving method of the liquid crystal display device in the present invention. The operation of the data driver will be described using a liquid crystal display device having 240 scanning electrodes and 4 simultaneous selection lines.

The data driver 150 of the present invention comprises a buffer means 153, a data accumulation means 154, a decoding means 155, a drive means 156 and a control means 151.

The buffer means 153:

buffers the display being transferred to the data driver for four lines at a time.

The data accumulation means 154:

contains memory capacity for one screen, accumulates display data buffered by the buffer means 153 for four lines at a time while the display data are read for four lines at a time and the display data being read are output to the decoding means 155.

The decoding means 155:

determines and outputs data signals from the selection pattern of scanning signals and displays data to the drive means 156 and the drive means 156, in turn, outputs data signals to signal electrodes (204).

The data accumulation means 154 in the present embodiment has the memory capacity of only one frame to save memory space, differing from a data accumulation means having memory capacity of 2 frames.

Figure 16:
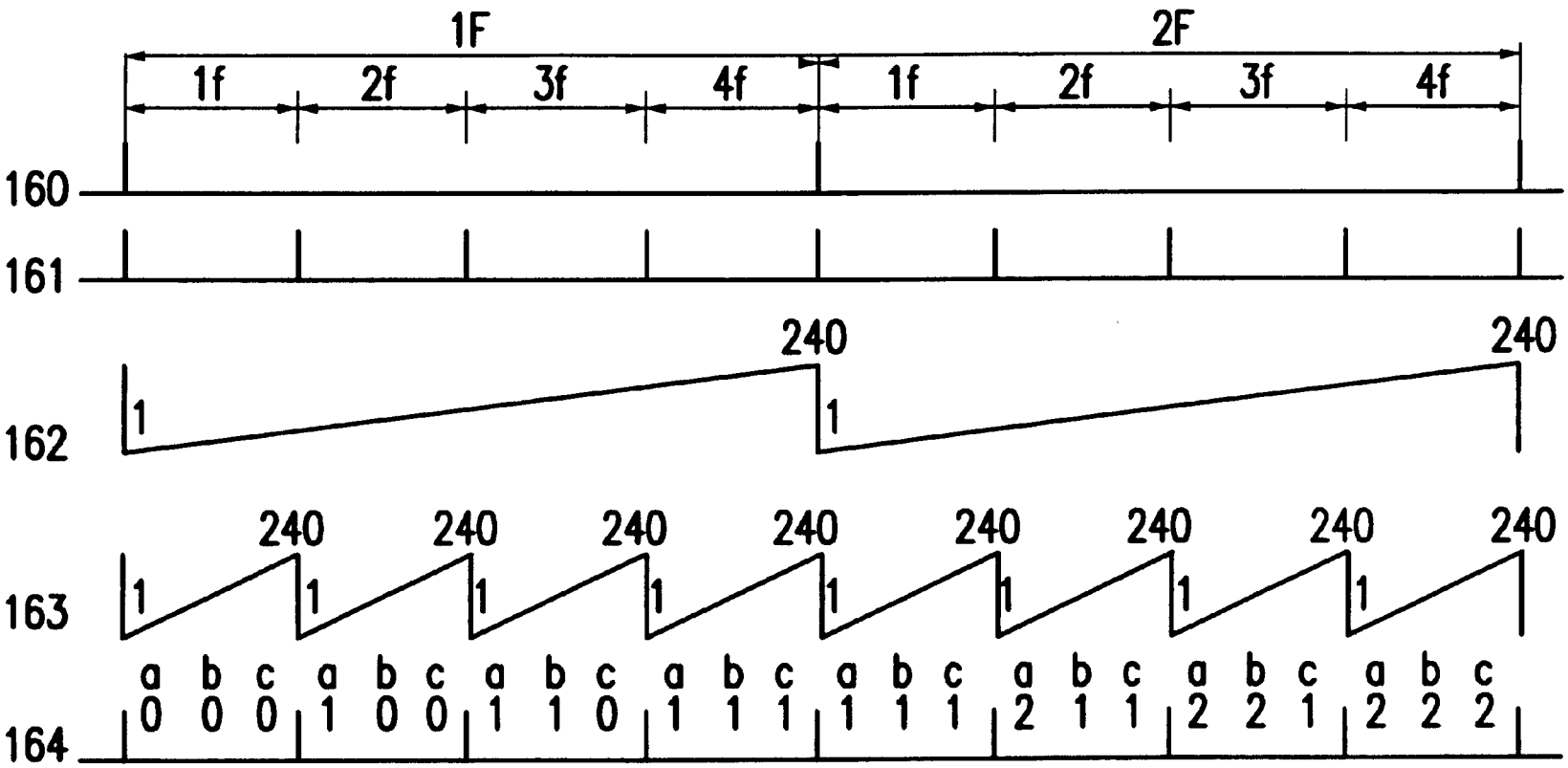
FIG. 16 is a drawing illustrating writing and reading timing of the display data on the data accumulation means, and switching timing of display data in the fourteenth embodiment.

Hence the writing and reading timings of display data are different for the data accumulation means 154. FIG. 16 illustrates the writing and reading timing of display data of the data driver 150 to the data accumulation means 154, and switching timing of the display data in FIG. 15.

An interval between one pulse voltage to the next pulse voltage of frame signal 160 is a period corresponding to one frame, during which period, display data are written on the data accumulation means 154 from the first line to 240th line in order as described in 162, at the same time the display data are read from the data accumulation means 154 from the first line to 240th line in order for 4 lines at ta time as described in 163. In this manner, reading of display data for one screen is completed during the period corresponding to one field and this reading operation is repeated four times for each frame.

Figure 17:
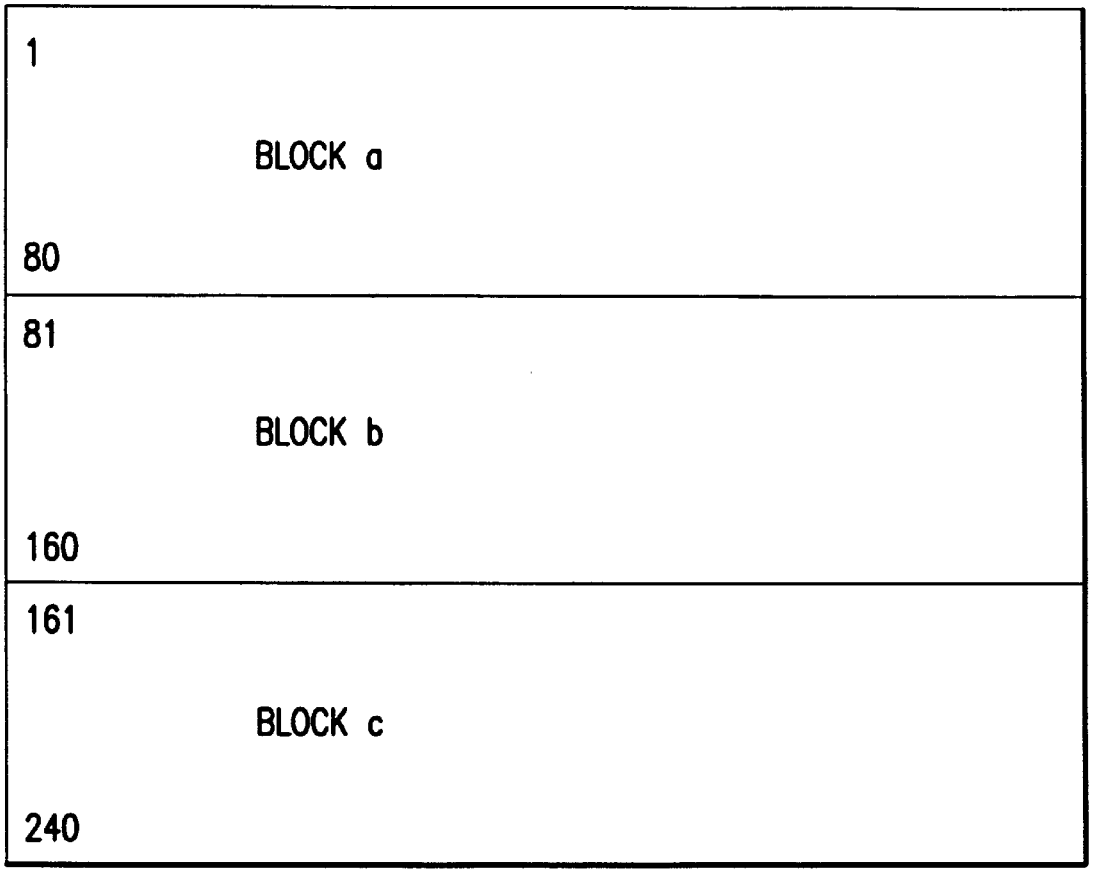
FIG. 17 is a drawing illustrating the switching timing of the display data in the fourteenth embodiment.

Since the writing period and the reading period are different as described above, the timing of switching display data become shifted for block a, block b and block c of display screen in FIG. 17. The timing of switching display data at each location of block a, block b and block c is shown in 164. Each location in 164 is denoted by a, b and c while the numbers 0, 1 and 2 denotes each frame.

In block a the display data switches between 1*f* and 2*f*, in block b the display data switches between 2*f* and 3*f*, and in block c the display data switches between 3*f* and 4*f*.

When the timing of switching display data changes depending on each location in one screen such as above, it becomes necessary to change combination of selection pattern of scanning signal for each location. Hence, a selection pattern switching means 152 is provided in the control circuit 151 in FIG. 15:

to detect the scanning electrode of the selection pattern switching means 152 on which display data are read and transferred to the decoding means 155, and to transfer selection pattern to decoding means 155 by switching selection pattern according to the result of detection.

Figure 18:
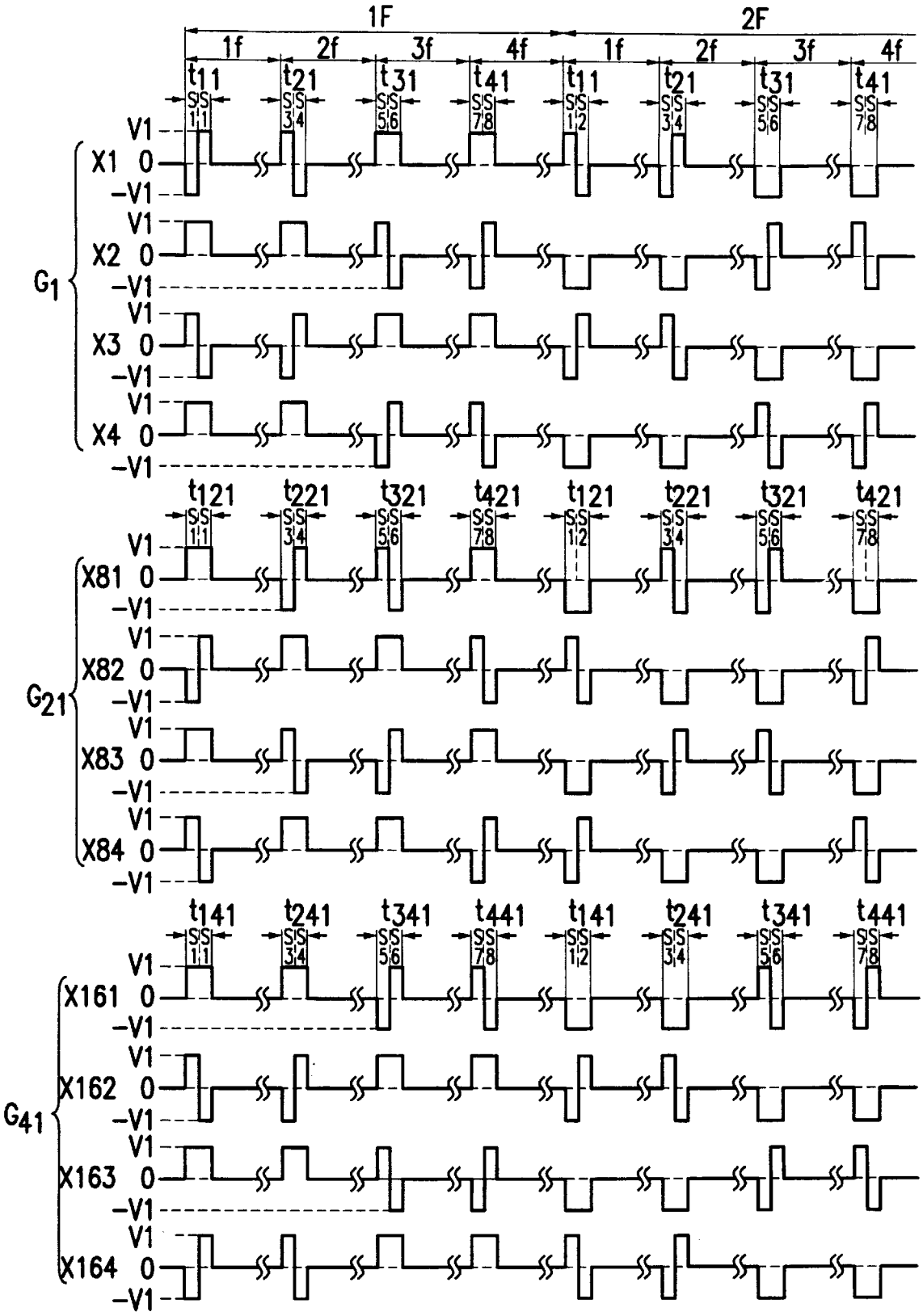
FIG. 18 is a drawing illustrating the driving wave pattern in the fourteenth embodiment.
Figure 19:
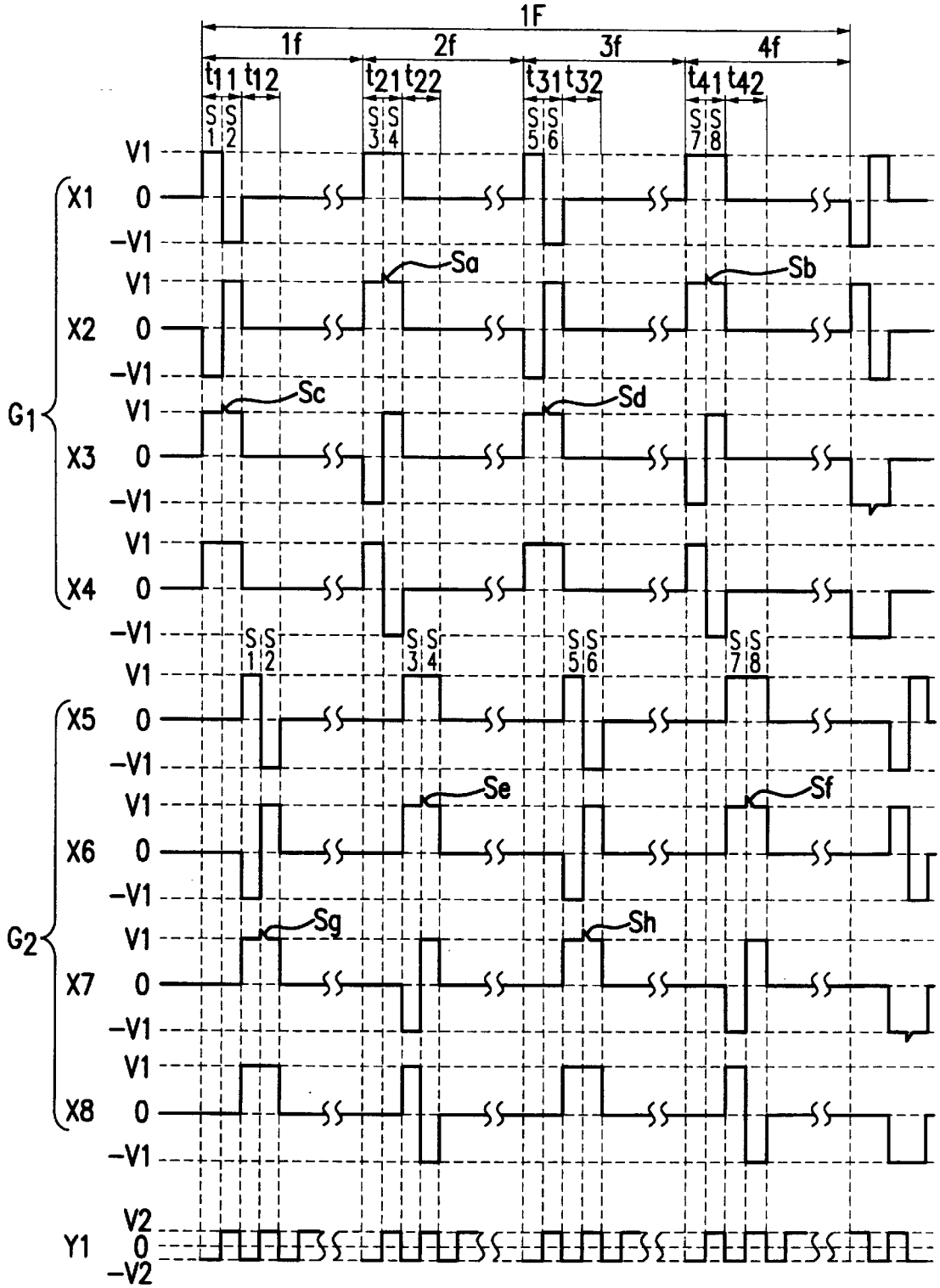
FIG. 19 is a drawing illustrating the driving wave pattern of a sample in comparison with the first embodiment.

Moreover, the scanning driver outputs the selection pattern of the scanning signal to each location of one screen as illustrated in FIG. 18, by changing the selection pattern to match selection pattern of the selection pattern switching means 152.

The pattern of selection signals of the present embodiment can be produced from the driving wave pattern of a conventional multi-line driving method described in FIG. 23 as follows:

First, the case of block a in FIG. 17 will be explained using scanning electrodes (X1–X4) belonging to G1 in FIG. 18 as an example. In the case of selection signal of X1 in the FIG. 23, there are 8 divided sub-selection periods (s1–s8) in one frame and the electric potentials of 8 selection signals corresponding to these divided sub selection periods are denoted, in order, by Vs1, Vs2, . . . , Vs8.

Moreover, these 8 electric potentials Vs1–Vs8 are switched in 8 divided sub selection periods so that the order of 8 electric potentials becomes Vs5, Vs1, Vs2, Vs6, Vs7, Vs3, Vs4, Vs8, from the beginning of one frame.

Next, the case of block b in FIG. 17 will be explained using scanning electrodes (X81–X84) belonging to G21 in FIG. 18 as an example:

In the case of selection signal of X1 in the FIG. 23, there are 8 divided sub-selection periods (s1–s8) in one frame and the electric potentials of 8 selection signals corresponding to these divided sub selection periods are denoted, in order, by Vs1, Vs2, . . . , Vs8.

Moreover, these 8 electric potentials Vs1–Vs8 are switched in 8 divided sub selection periods so that the order of 8 electric potentials becomes Vs3, Vs7, Vs5, Vs1, Vs2, Vs6, Vs8, Vs4, from the beginning of one frame.

Finally, the case of block c in FIG. 17 will be explained using scanning electrodes (X161–X164) belonging to G41 in FIG. 18 as an example:

In the case of selection signal of X1 in the FIG. 23, there are 8 divided sub-selection periods (s1–s8) in one frame and the electric potentials of 8 selection signals corresponding to these divided sub selection periods are denoted, in order, by Vs1, Vs2, . . . , Vs8.

Moreover, these 8 electric potentials Vs1–Vs8 are switched in 8 divided sub selection periods so that the order of 8 electric potentials becomes Vs7, Vs3, Vs4, Vs8, Vs5, Vs1, Vs2, Vs6, from the beginning of one frame.

Hence, the driving method of the liquid crystal display device in the present invention has a structure wherein the pattern of switching electric potentials of selection signals between p×q divided sub-selection period within one frame is different for each block (block a, block b, block c) having different switching timing of display data for each display element in the display screen.

The pattern of switching electric potential of selection signals for each block is explained next.

First, in block a, display data are switched between the first field and second field in each frame as described in 164 of FIG. 16. Hence the order of the pattern of the appearance of the electric potential of selection signals is reversed between divided sub-selection period s3, s4, s5, s6 included in the second field and third field and divided sub-selection period s7, s8, s1, s2 included in the fourth field and first field of the next frame in each field.

Next, in block b, the display data are switched between the second field and third field in each frame as described in 164 of FIG. 16. Hence the order of the pattern of the appearance of the electric potential of selection signals is reversed between the divided sub-selection period s5, s6, s7, s8 included in the third field and the fourth field and the divided sub-selection period s1, s2, s3, s4 included in the first field and the second field of the next frame in each field.

Finally, in block c, display data are switched between the third field and the fourth field in each frame as described in 164 of FIG. 16. Hence the order of the pattern of the appearance of the electric potential of selection signals is reversed between divided sub-selection period s7, s8, s1, s2 included in the fourth field and the first field of the next frame and the divided sub-selection period s3, s4, s5, s6 included in the second field and the third field of the next frame in each frame.

Here, because a similar driving method is used in the present embodiment as the driving method of embodiment 8, the order of the pattern of the appearance of the electric potential is reversed between:

the selection signals given during the first 4 divided sub-selection periods and the selection signals given during the last 4 divided sub-selection periods out of 8 divided sub-selection periods included in the periods corresponding to switching timing of display data but the method of switching the electric potential of the selection signals between the 8 divided sub-selection periods is not limited to the present embodiment and the driving methods of other embodiments can be used equally well.

Scanning of the driving method of the liquid crystal display device in the present embodiment is executed as follows:

First, selection signals of scanning signals X1–X4 are applied to first to fourth scanning electrodes corresponding to block a in FIG. 17 at sub-selection period t11, and selection signals of scanning signals X5–X8 are applied to the next fifth to eighth scanning electrodes at the sub-selection period t12 (not shown), and operation of block a is completed when the above operation is repeated 20 times.

Next, operation of block b in FIG. 17 begins:

Selection signals of scanning signals X81–X84 are applied to the 81st to 84th scanning electrodes corresponding to block b in FIG. 17 at sub-selection period t121 and selection signals of the scanning signals X85–X88 are applied to the next 85th to 88th scanning electrodes at sub-selection period t122 (not shown), and operation of block b in FIG. 17 is completed when the above operation is repeated 20 times.

Next, operation of block c in FIG. 17 begins.

Selection signals of scanning signals X161–X164 are applied to 161st to 164th scanning electrodes corresponding to block c in FIG. 17 at sub-selection period t141 and selection signals of scanning signals X165–X168 are applied to next 165th to 168th scanning electrodes at sub-selection period t142 (not shown), and operation of block c is completes when the above operation is repeated 20 times.

When scanning of the first to the 240th scanning electrodes is completed by selecting four scanning electrodes at a time in this manner, the operation in the first field (1*f*) is completed and the operation of the second field (2*f*) begins where 1st to 240th scanning electrodes are scanned by selecting four scanning electrodes simultaneously as in the case of first field (1*f*). This operation is repeated until scanning of fourth field is completed at which time the operation of the first frame (1*f*) is completed.

As explained above, in the driving method of the liquid crystal display device in the present embodiment, a structure is provided wherein the pattern of switching of electric potentials are different between the selection signals of p×q divided sub-selection periods within one frame for each block with different timing of switching of display data for each display element in the display screen, hence effects of (1) controlling unevenness of display in the direction of signal electrode (normally vertical direction), (2) not causing especially severe uneven display in the direction of signal electrode and flickering even when the display contents change one after another, and (3) prevention of occurrence of uneven display in the direction of scanning electrode (normally horizontal direction) are achieved even for the liquid crystal display device comprising a data accumulation means with memory capacity only for one frame.

Embodiment 15

Liquid crystal display devices using the driving method of the liquid crystal display device shown in embodiments 1–14 are produced and the characteristics are evaluated. As a result, superior merit of not having uneven display and flickering in vertical and horizontal direction, and having high speed response and excellent contrast characteristics is confirmed. In addition, the devices are found to give a feeling of little fatigue to the users even when the devices are used for a long time.

Use of these liquid crystal display devices as display devices for electronic equipment such as small portable terminals, notebook PCs, and small televisions enables creation of electronic equipment such as small portable terminals, notebook PCs and small televisions.

A driving circuit structured to generate scanning signals to drive these liquid crystal display devices and a driving circuit structured to generate data signals to drive these liquid crystal display devices are indispensable in creating such liquid crystal display devices.

Here, the driving method of the liquid crystal display device in the present invention is explained using an embodiment in which four scanning lines are selected simultaneously and another embodiment in which six scanning lines are selected simultaneously, but the number of scanning lines to be selected simultaneously is not limited to these embodiments and an arbitrary number can be used. Moreover, the driving method of the liquid crystal display device in the present invention can be applied to gradation display such as pulse width modulation, FRC modulation, voltage gradation.

As explained above, the present invention is suited for providing a simple matrix type liquid crystal display device with superior display quality capable of:

(1) controlling of unevenness of display in the direction of signal electrode (normally vertical direction) and (2) not causing of especially severe uneven display in the direction of signal electrode and flickering even when the display contents change one after another, and (3) prevention of the occurrence of an uneven display in the direction of scanning electrode (normally horizontal direction); electronic equipment such as small portable terminals, notebook PCs, and small televisions comprising such liquid crystal display device; and a driving circuit to drive such liquid crystal display device.

What is claimed is:

1. A method for driving a liquid crystal display device, the liquid crystal display device comprising a plurality of scanning electrodes that are divided into groups, each of the scanning electrodes being applied with a scanning signal having a selection period and a non-selection period within a frame, a plurality of the scanning signals applied to the groups of scanning electrodes within the frame also corresponding to groups of the scanning signals respectively, the groups of scanning electrodes being concurrently driven by a corresponding one of the groups of scanning signals, the selection period of each scanning signal having p sub-selection periods within the frames, where p is an integer, the method comprising:

dividing each of p sub-selection periods into q divided-sub-selection periods; and applying the plurality of scanning signals having electric potentials that correspond to q divided-sub-selection periods to the scanning electrodes, the electric potentials applied to each of p×q divided-sub-selection periods being arranged so that an affect of spikes in voltage from the scanning signals applied to adjacent scanning electrodes is canceled.

2. The method of claim 1, polarities of electric potentials of the scanning signal during each of p×q divided-sub-selection periods being one of positive and negative relative to an electric potential of the scanning signal during the non-selection period.

3. The method of claim 2, data signals applied to the display elements being determined based on a pattern of the electric potential polarities of the group of scanning signals during the selection period and data to be displayed on the liquid crystal display device.

4. The method of claim 1, a pattern of the electric potential polarities of each group of scanning signals during the p×q divided-sub-selection periods being mutually in orthogonal relation.

5. The method of claim 1, q being an even integer.

6. The method of claim 5, q being equal to 2.

7. The method of claim 1, a sequential pattern of the electric potential polarities of each of the scanning signals being reversed within a given time period.

8. The method of claim 7, the given time period being one frame.

9. The method of claim 1, a sequential pattern of the electric potential polarities of each of the scanning signals being reversed with a first half pattern and a second half pattern within a given time period, and the electric potential polarities of a part of the second half pattern changing place with each other.

10. The method of claim 1, a pattern of the electric potential polarities of one of the groups of scanning signals during last ones of the q divided-sub-selection periods of at least one of the p sub-selection periods being the same as a pattern of the electric potential polarities of the following one of the groups of scanning signals during first ones of the q dividing-sub-selection periods of at least one of the p sub-selection periods.

11. The method of claim 1, a pattern of the electric potential polarities of one of the groups of scanning signals during at least one of the p sub-selection periods and a pattern of the electric potential polarities of the following one of the groups of scanning signals during at least one of the p sub-selection periods being reversed between each other.

12. The method of claim 1, a pattern of the electric potential polarities of a first group of scanning signals during last ones of the q divided-sub-selection periods of at least one of the p sub-selection periods being the same as a pattern of the electric potential polarities of a second group of scanning signals during first ones of the q dividing-sub-selection periods of at least one of the p sub-selection periods, and a pattern of the electric potential polarities of a third group of scanning signals during at least one of the p sub-selection periods and a pattern of the electric potential polarities of a fourth group of scanning signals during at least one of the p sub-selection periods being reversed between each other.

13. The method of claim 1, each of the p×q divided-sub-selection periods being separated from other ones of the p×q divided-sub-selection periods by the non-selection period.

14. The method of claim 1, the groups of scanning electrodes corresponding to a display screen being divided into a plurality of blocks, and the patterns of electric potential polarities of the groups of scanning signals in the plurality of blocks differing from each other on the basis of the blocks.

15. A method for driving a liquid crystal display device, the liquid crystal display device comprising a plurality of scanning electrodes that are divided into groups, each of the scanning electrodes being applied with a scanning signal having a selection period and a non-selection period within a frame, a plurality of the scanning signals applied to the groups of scanning electrodes within the frame also corresponding to groups of the scanning signals respectively, the groups of scanning electrodes being concurrently driven by a corresponding one of the groups of scanning signals, the selection period of each scanning signal having p sub-selection periods within the frame, where p is an integer, the method comprising:

dividing each of a p sub-selection periods into q divided-sub-selection periods; and applying the plurality of scanning signals having electric potentials that correspond to q divided-sub-selection periods to the scanning electrodes, the electric potentials applied to each of p×q divided-sub-selection periods being arranged so that spike voltages affected by the scanning signals applied to adjacent scanning electrodes within a given frame are generated toward a first polarity direction and a second polarity direction and a number of the spike voltages toward the first polarity direction and a number of the spike voltages toward the second polarity direction are equal to each other within the given frame.

16. The method of claim 15, data signals applied to the display elements being determined based on a pattern of the electric potential polarities of the group of scanning signals during the selection period and data to be displayed on the liquid crystal display device.

17. The method of claim 15, a pattern of the electric potential polarities of each group of scanning signals during the p×q divided-sub-selection periods being mutually in orthogonal relation.

18. The method of claim 15, q being an even integer.

19. The method of claim 18, q being equal to 2.

20. The method of claim 15, a sequential pattern of the electric potential polarities of each of the scanning signals being reversed within a given time period.

21. The method of claim 20, the given time period being one frame.

22. The method of claim 15, a sequential pattern of the electric potential polarities of each of the scanning signals being reversed with a first half pattern and a second half pattern within a given time period, and the electric potential polarities of a part of the second half pattern changing place with each other.

23. The method of claim 15, a pattern of the electric potential polarities of one of the groups of scanning signals during last ones of the q divided-sub-selection periods of at least one of the p sub-selection periods being the same as a pattern of the electric potential polarities of the following one of the groups of scanning signals during first ones of the q dividing-sub-selection periods of at least one of the p sub-selection periods.

24. The method of claim 15, a pattern of the electric potential polarities of one of the groups of scanning signals during at least one of the p sub-selection periods and a pattern of the electric potential polarities of the following one of the groups of scanning signals during at least one of the p sub-selection periods being reversed between each other.

25. A method for driving a liquid crystal display device, the liquid crystal display device comprising a plurality of scanning electrodes that are divided into groups, each of the scanning electrodes being applied with a scanning signal having a selection period and a non-selection period within a frame, a plurality of the scanning signals applied to the groups of scanning electrodes within the frame also corresponding to groups of the scanning signals respectively, the groups of scanning electrodes being concurrently driven by a corresponding one of the groups of scanning signals, the selection period of each scanning signal having p sub-selection periods within the frames, where p is an integer, the method comprising:

dividing each of the p sub-selection periods into q divided-sub-selection periods; and applying the plurality of scanning signals having electric potentials that correspond to q divided-sub-selection periods to the scanning electrodes, the electric potentials applied to each of p×q divided-sub-selection periods being arranged so that a sequential pattern of the electric potential polarities of each of the scanning signals during the p×q divided-sub-selection periods reverses with a first half pattern and a second half pattern within a given time period.

26. A method for driving a liquid crystal display device, the liquid crystal display device comprising a plurality of scanning electrodes that are divided into groups, each of the scanning electrodes being applied with a scanning signal having a selection period and a non-selection period within a frame, a plurality of the scanning signals applied to the groups of scanning electrodes within the frame also corresponding to groups of the scanning signals respectively, the groups of scanning electrodes being concurrently driven by a corresponding one of the groups of scanning signals, the selection period of each scanning signal having p sub-selection periods within the frames, where p is an integer, the method comprising:

dividing each of the p sub-selection periods into q divided-sub-selection periods; and applying the plurality of scanning signals having electric potentials that correspond to q divided-sub-selection periods to the scanning electrodes, the electric potentials applied to each of p×q divided-sub-selection period being arranged so that a sequential pattern of the electric potential polarities of each of the scanning signals during the p×q divided-sub-selection periods reverses with first half pattern and second half pattern within a given time period and the electric potential polarities of a part of the second half pattern of each of the scanning electrodes changing place with each other.

27. A method for driving a liquid crystal display device, the liquid crystal display device comprising a plurality of scanning electrodes that are divided into groups, each of the scanning electrodes being applied with a scanning signal having a selection period and a non-selection period within a frame, a plurality of the scanning signals applied to the groups of scanning electrodes within the frame also corresponding to groups of the scanning signals respectively, the groups of scanning electrodes being concurrently driven by a corresponding one of the groups of scanning signals, the selection period of each scanning signal having p sub-selection periods within the frames, where p is an integer, the method comprising:

dividing each of p sub-selection periods into q divided-sub-selection periods; and applying the plurality of scanning signals having electric potentials that correspond to q divided-sub-selection periods to the scanning electrodes, the electric potentials applied to each of p×q divided-sub-selection periods being arranged so that a pattern of the electric potential polarities of one of the groups of scanning signals during last ones of the q divided-sub-selection periods of at least one of the p sub-selection periods are the same as a pattern of the electric potential polarities of the following one of the groups of scanning signals during the first ones of the q divided-sub-selection periods of at least one of the p sub-selection periods.

28. A method for driving a liquid crystal display device, the liquid crystal display device comprising a plurality of scanning electrodes that are divided into groups, each of the scanning electrodes being applied with a scanning signal having a selection period and a non-selection period within a frame, a plurality of the scanning signals applied to the groups of scanning electrodes within the frame also corresponding to groups of the scanning signals respectively, the groups of scanning electrodes being concurrently driven by a corresponding one of the groups of scanning signals, the selection period of each scanning signal having p sub-selection periods within the frames, where p is an integer, the method comprising:

dividing each of p sub-selection periods into q divided-sub-selection periods; and applying the plurality of scanning signals having electric potentials that correspond to q divided-sub-selection periods to the scanning electrodes, the electric potentials applied to each of p×q divided-sub-selection periods being arranged so that a pattern of the electric potential polarities of one of the groups of scanning signals during at least one of the p sub-selection periods and a pattern of the electric potential polarities of the following one of the groups of scanning during at least one of the p sub-selection periods reverse between each other.

29. A method for driving a liquid crystal display device, the liquid crystal display device comprising a plurality of scanning electrodes that are divided into groups, each of the scanning electrodes being applied with a scanning signal having a selection period and a non-selection period within a frame, a plurality of the scanning signals applied to the groups of scanning electrodes within the frame also corresponding to groups of the scanning signals respectively, the groups of scanning electrodes being concurrently driven by a corresponding one of the groups of scanning signals, the selection period of each scanning signal having p sub-selection periods within the frames, where p is an integer, the method comprising:

dividing each of p sub-selection periods into q divided-sub-selection periods; and applying the plurality of scanning signals having electric potentials that correspond to q divided-sub-selection periods to the scanning electrodes, the electric potentials applied to each of p×q divided-sub-selection periods being arranged so that a pattern of the electric potential polarities of a first group of scanning signals during last ones of the q divided-sub-selection periods of at least one of the p sub-selection periods are the same as a pattern of the electric potential polarities of a second group of scanning signals during first ones of the q dividing-sub-selection periods of at least one of the p sub-selection periods and a pattern of the electric potential polarities of a third group of scanning signals during at least one of the p sub-selection periods and a pattern of the electric potential polarities of a fourth group of scanning signals during at least one of the p sub-selection periods are reversed between each other.

30. A method for driving a liquid crystal display device, the liquid crystal display device comprising a plurality of scanning electrodes that are divided into groups, each of the scanning electrodes being applied with a scanning signal having a selection period and a non-selection period within a frame, a plurality of the scanning signals applied to the groups of scanning electrodes within the frame also corresponding to groups of the scanning signals respectively, the groups of scanning electrodes being concurrently driven by a corresponding one of the groups of scanning signals, the selection period of each scanning signal having p sub-selection periods within the frames, where p is an integer, the method comprising:

dividing each of p sub-selection periods into q divided-sub-selection periods; and applying the plurality of scanning signals having electric potentials that correspond to q divided-sub-selection periods to the scanning electrodes, the electric potentials applied to each of p×q divided-sub-selection periods being arranged so that the groups of scanning electrodes corresponding to a display screen are divided into a plurality of blocks and the patterns of electric potential polarities of the groups of scanning signals in the plurality of blocks differing from each other on the basis of the blocks.

31. A liquid crystal display device which includes a plurality of scanning electrodes that are divided into groups, each of the scanning electrodes being applied with a scanning signals having a selection period and a non-selection period within a frame, a plurality of the scanning signals applied to the groups of scanning electrodes within the frame also corresponding to groups of the scanning signals respectively, the groups of scanning electrodes being concurrently driven by a corresponding one of the groups of scanning signals, the selection period of each scanning signal having p sub-selection periods within the frame, where p is an integer, comprising:

a scanning driver that applies the plurality of scanning signal have electric potentials on the basis of q divided-sub-selection periods into which each of p sub-selection periods is divided, the electric potentials applied to each of p×q divided-sub-selection periods being arranged so that an affect of spikes in a voltage from the scanning signals applied to adjacent scanning electrodes is canceled.

32. The device of claim 31, polarities of electric potentials of the scanning signal during each of p×q divided-sub-selection periods being one of positive and negative relative to an electric potential of the scanning signal during the non-selection period.

33. The device of claim 31, further comprising:

a data driver that applies data signals for driving a display element.

34. The device of claim 33, the data signals being determined based on a pattern of the electric potential polarities of the group of scanning signals during the selection period and data to be displayed on the liquid crystal display device.

35. The device of claim 34, a pattern of the electric potential polarities of each group of scanning signals during the p×q divided-sub-selection periods being mutually in orthogonal relation.

36. A method for driving a liquid crystal display device, the liquid crystal display device comprising a plurality of scanning electrodes that are divided into groups, each of the groups of scanning electrodes being driven by a corresponding plurality of scanning signals that are also divided into groups, each of the groups of scanning electrodes being concurrently driven by a corresponding one of the groups of scanning signals, the groups of scanning signals having a selection period and a non-selection period within a frame, the selection period having p sub-selection periods, where p is an integer greater than 1, the method comprising:

applying the plurality of scanning signals having electric potentials that correspond to q divided sub-selection periods of each of the p sub-selection periods, wherein a pattern of electric potentials of the plurality of scanning signals corresponding to a second half of the p×q divided sub-selection periods is a reverse of a pattern of electric potentials of the plurality of scanning signals corresponding to a first half of the p×q divided sub-selection periods.

37. The method of claim 36, wherein the pattern of electric potentials of the plurality of scanning signals corresponding to the second half of the p×q divided sub-selection periods is reversed.

38. The method of claim 37, wherein at least two of the sub-selection periods are reversed.

39. The method of claim 38, wherein p is 4 and the second sub-selection period and the third sub-selection period are reversed.

40. A method for driving a liquid crystal display device, the liquid crystal display device comprising a plurality of scanning electrodes being driven by a corresponding plurality of scanning signals that are also divided into groups, each of the groups of scanning electrodes being concurrently driven by a corresponding one of the groups of scanning signals, the groups of scanning signals having a selection period and a non-selection period within a frame, the selection period having p sub-selection periods, where p is an integer greater than 1, the method comprising:

applying the plurality of scanning signals having electric potentials that correspond to the p sub-selection periods, wherein the number of positive polarity spikes is equal to the number of negative polarity spikes, wherein the polarity of the spikes is based on the electric potential of the scanning signal.

41. A liquid crystal display device comprising:

a plurality of scanning electrodes that are divided into groups, each of the groups of scanning electrodes being driven by a corresponding plurality of scanning signals that are also divided into groups, the groups of scanning signals having a selection period and a non-selection period within a frame, the selection period having p sub-selection periods, where p is an integer greater than 1; and applying means for applying the plurality of scanning signals having electric potentials that correspond to q divided sub-selection periods of each of the p sub-selection periods, wherein a pattern of electric potentials of the plurality of scanning signals corresponding to a second half of the p×q divided sub-selection periods is a reverse of a pattern of electric potentials of the plurality of scanning signals corresponding to a first half of the p×q divided sub-selection periods.

* * * * *